United States Patent [19]

Bravin

[11] 4,235,070

[45] Nov. 25, 1980

[54] WIRE STRANDING MACHINE AND CONTROL MEANS THEREFOR

[75] Inventor: Ben Bravin, Los Angeles, Calif.

[73] Assignee: Dynamex Corporation, Long Beach, Calif.

[21] Appl. No.: 944,149

[22] Filed: Sep. 20, 1978

[51] Int. Cl.[3] ..... D07B 3/08; D07B 7/10; B65H 54/02

[52] U.S. Cl. ..... 57/71; 57/99; 57/267; 242/25 R; 242/54 R

[58] Field of Search ..... 57/67, 68, 70, 71, 93, 57/95, 98, 99, 267; 242/18 R, 54, 25 R, 25 A

[56] References Cited

U.S. PATENT DOCUMENTS

| | | | |
|---|---|---|---|
| 1,601,340 | 9/1926 | Boyd et al. | 57/267 |
| 2,663,507 | 12/1953 | Soussloff | 242/18 A |
| 2,817,948 | 12/1957 | Cook | 57/71 X |
| 2,929,193 | 3/1960 | Cook | 57/67 |
| 2,930,537 | 3/1960 | Davis et al. | 242/25 A |
| 2,932,462 | 4/1960 | Nelson | 242/25 A |
| 3,091,911 | 6/1963 | Turner | 57/71 X |
| 3,099,117 | 7/1963 | Christiansen | 242/25 R X |
| 3,677,483 | 7/1972 | Henrich | 242/25 R |
| 3,785,137 | 1/1974 | Karlson | 57/71 |
| 3,848,405 | 11/1974 | Karlson | 57/71 |
| 4,046,331 | 9/1977 | Decker, Sr. | 242/54 R |
| 4,128,988 | 12/1978 | Ragan | 57/71 X |

*Primary Examiner*—John Petrakes

*Attorney, Agent, or Firm*—Blakely, Sokoloff, Taylor & Zafman

[57] ABSTRACT

A single-twist wire stranding or bunching machine having a reciprocating flyer traversing the length of a take-up reel and rotating coaxially with respect thereto, such take-up reel being mounted within pivoting means to facilitate easy removal of the reel after it is fully wound with wire. The invented machine comprises electro-mechanical means for automatically controlling the uniformity of the lay length of the twisted wire by correcting for changes in the velocity of the wire being fed into the machine due to wire build-up on the reel or to reversals of the traversing flyer. Additional control means are also disclosed for automatically controlling the points at which the flyer, in its reciprocating motion, reverses direction, thereby minimizing wire accumulations or recesses at the end flanges of the reel.

33 Claims, 10 Drawing Figures

316a
L Z MOTOR
352a
CURRENT POLARITY CONTROL MEANS
348a
SW
354
POWER SUPPLY
356
348b
SW
352b
CURRENT POLARITY CONTROL MEANS
316b
R Z MOTOR 350a
350b
LZ/ACC
LZ/REC
RZ/ACC
RZ/REC
344a
346
TIMER CIRCUIT
342
344b
330
340₁
340₂
340₃
340₄
RESET S/G
COUNTER 1
COUNTER 2
COUNTER 3
COUNTER 4
RESET
338
E1 OR E2
LZ
RZ
332a
334a
336
332b
334b
312a
312b
DC
ACC
REC
E1
E2

WIRE STRANDING MACHINE AND CONTROL MEANS THEREFOR

BACKGROUND OF THE INVENTION

1. Field of the Invention

The present invention relates generally to wire stranding machines, and more particularly, to an automatic, single-twist stranding machine having a reciprocating flyer and improved control means for increased lay length accuracy and greater uniformity of the layers of wire wound on the reel.

2. Prior Art

Machines for twisting a plurality of wires into a single twisted wire bunch and winding the same onto a reel are well known. One such machine is described in U.S. Pat. No. 2,817,948 issued to Cook. The Cook stranding machine comprises a rotatable flyer and a reciprocally traversing reel rotatably supported within the flyer. A differential exists between the rate of rotation of the flyer and reel. A plurality of wire strands are fed from sources, external to the machine, to the flyer for twisting the strands together. Due to the differential in rotation rates, the twisted strands are then wound from the flyer onto the reel. Moreover, because the even layers thereon.

It is well known that, in order for the lay length (i.e., the length of each twist) to be kept constant, a fixed length of the wire strands must enter the machine for each rotation of the flyer. The length of wire which enters the machine during each rotation of the flyer depends upon the velocity of between the flyer and reel, and (ii) the instantaneous diameter of the combined reel and wound wire (referred to hereinafter as the "effective diameter" of the reel).

It is well known that, as the effective diameter of the reel increases, the tangential velocity of the wire winding circumferentially onto the reel will tend to increase, notwithstanding a fixed rate of rotation of the reel. Therefore, in order to maintain a constant lay length, it is necessary to reduce, continually, the rate of rotation of the reel to compensate for the continually increasing effective diameter thereof, as twisted wire is wound thereon. The Cook machine disclosed in U.S. Pat. No. 2,817,948 includes a means for periodically reducing the rate of rotation of the reel by means of an adjustable pulley mounted on a shaft 59 which is coupled to the reel shaft. The surface of the adjustable pulley, which is in contact with a drive belt, can be manually varied so as to change the effective diameter of the pulley, thereby adjusting the speed of shaft 59. By so adjusting the speed of shaft 59, the speed of the reel shaft coupled thereto can be controlled. As indicated above, the control sought is a reduction of the reel's rate of rotation as the effective diameter thereof increases, in order to maintain a fixed wire velocity.

Although the Cook stranding machine was an improvement over earlier machines known to the prior art, it nevertheless fails to overcome several significant limitations and shortcomings of the prior art. For example, by reciprocating the reel within the flyer (the so-called "closed flyer"), the Cook machine tends to vibrate excessively as do earlier stranding machines. This is due to the fact that the distribution of the wire being wound onto a reciprocating and rotating reel is not perfectly uniform, causing a non-uniform weight, or out-of-balance, condition. The present invention overcomes this shortcoming by providing means for reciprocating the flyer with respect to a non-reciprocating reel. The flyer can be more accurately balanced, and the balance, once attained, is permanent and independent of wire buildup on the reel. Thus, this invention achieves a substantial reduction of vibration. In addition, the innovative feature of reciprocating the lighter flyer enables (i) the use of drive motors and bearings which are smaller and less expensive than those required for driving heavier reels, especially when loaded; and (ii) operation at higher speeds than possible with machines of the prior art.

A second significant shortcoming of the prior art, which is not eliminated by the Cook machine disclosed in U.S. Pat. No. 2,817,948, relates to the removal of loaded reels after a stranding, twisting and winding cycle is completed. In the prior art, reel removal is typically accomplished by positioning a hoist over the machine and lifting the reel upward and then to the side so that reel may be lowered to ground level. This is a slow process and one which requires the utilization of hoist means the space within which to move and operate the hoist. The present invention has overcome this shortcoming of the prior art by providing means for conveniently pivoting, i.e., lowering, the reel of wire from its take-up position to one approximately 90° removed therefrom, which is close to floor level. The foregoing pivotability of the reel support structure is enabled by the fact that the reel's support structure is not mechanically interconnected to means for reciprocating the rotating reel, as is the case with respect to prior art machines.

One of the reasons that stranding machines of the prior art did not utilize reciprocating flyers and stationary reels is that a reciprocating flyer tends to place pulling forces on the wire strands passing therethrough, as the traversing flyer reverses its direction. This tends to cause an accumulation of the wire strands as they pass through the flyer and, as a consequence thereof, a corresponding variation in the length of wire wound during each flyer revolution. When the latter length is varied, the lay length of the bunched wire is, by definition, likewise varied, resulting in an undesirable lack of uniformity of the lay length. The lay length control means known to the prior art lack the accuracy and responsiveness necessary to correct for any wire velocity variations introduced by a reciprocating flyer. However, the present invention comprises a closed loop, servo-actuated lay length control means which enables the lay length to be controlled to an accuracy heretofore not known to the art. By virtue of such control means, the advantages obtainable from a machine in which the flyer reciprocates with respect to a stationary reel, instead of vice versa, have been achieved; i.e., the reduction of vibration, the suitability of smaller and less expensive drive motors and bearings, and the drop-out, pivotable reel. In addition, the improved lay length control and reduction of vibration enable winding operations to be carried out at speeds higher than heretofore possible, withiout sacrificing, to any commercially significant degree, the uniformity of the lay length of the resulting bunched and twisted wire strands.

In many applications, wire having a highly uniform lay length is required. It is apparent from the design of the Cook machine disclosed in U.S. Pat. No. 2,817,948, that it is incapable of twisting the wire strands with a precise lay length, especially when small gauge wire is being used. This is because the reel speed is controlled by means of the above-described configuration. Such adjustable pulleys inherently lack the capability to maintain a constant drive ratio, because the diameter of the contacting pulley surface will vary with drive belt wear and tension. Inasmuch as the adjustable pulley and drive belt ultimately drive the reel shaft, the rate of rotation of the reel, and consequently the lay length of the wire, will also vary with belt wear and changes in tension.

A further disadvantage of the variable pulley control means taught by Cook is that only approximately 8% of the surface of the drive belt is in contact with the surface of the adjustable pulley, a condition which furthers the wearing out of the belt, which in turn, increases maintenance costs and machine down-time. Moreover, and perhaps more importantly, with only about 8% of the drive belt surface in contact with the variable pulley, a very inadequate dynamic range is provided for control of the rotation rate of the reel, from its unloaded to its fully loaded condition. This deficiency is further compounded by the fact that the Cook machine disclosed in U.S. Pat. No. 2,817,948 is one which is manually operated by an attendant looking at a speedometer measuring the velocity of the wire strands being fed into the machine. As the lineal wire velocity increases, due to the increasing effective diameter of the reel, the attendant, observing the same, periodically rotates a shaft which varies the adjustable pulley. In this manner, the reel speed is reduced, and therefore, the speed at which the wire is being pulled into the machine. Thus, in addition to the inherent inaccuracy of the variable pulley and belt drive control means, and the inadequacy of its dynamic range, the lay length accuracy attainable by the above-cited Cook machine may be further reduced by the lack of skill and attentiveness of the attendant.

A second patent issued to Cook, U.S. Pat. No. 2,929,193, discloses various embodiments of an automatic speed control device which eliminates the requirement that an attendant periodically reduce the reel speed. Although the use of the Cook speed controls disclosed in the foregoing Cook patent eliminates the inaccuracy of lay length uniformity attributable to the attendant, the inherent inaccuracy of a variable pulley control means nevertheless remains.

With reference to the Cook machines disclosed in U.S. Pat. No. 2,929,193, attention is now directed to his means for generating the "error" signal which is coupled to, and adapted to adjust, the variable pulley and belt control means. In one embodiment, Cook uses a synchronous motor, as a reference, to drive a disk having electrically conducting studs extending outwardly therefrom. Rotating concentrically with the disk is a shaft 17 having an electrically conducting eccentric arm. The shaft 17 is driven by a pulley which is itself driven by a wire strand being fed into the machine; therefore, the rate of rotation of the shaft 17 is proportional to the velocity of the wire strand. As the effective diameter of the reel increases, the velocity of the wire increases, causing the shaft 17 to rotate faster, until the extended arm affixed thereto makes electrical contact with one of the conducting studs on the concentrically rotating disk. The electrical error signal generated is coupled to a servo motor which actuates the variable pulley-belt control means to slow the reel speed, and thereby to disengage the contacting stud and arm. The foregoing error signal generating means, while controlling the reel rate of rotation, is incapable of making corrections for variations in the rate of rotation of the flyer. It should be recalled that the achievement of uniform and accurate lay lengths requires that the length of wire pulled into the machine for each revolution of the flyer be maintained constant. If the flyer speed changes, the period of one rotation changes; consequently, the lay length changes correspondingly. On the above-described Cook control device, the error signal is generated whenever the reel speed reaches a predetermined level corresponding to the speed of the reference synchronous motor. Inasmuch as the fixed speed of the reference is unrelated to the flyer speed, the capability of the foregoing control means is inherently limited. On the other hand, the lay length control means disclosed in the present invention is responsive to variations in the speed of the flyer as well as to wire buildup on the reel, and therefore, it is capable of greater lay length control accuracy than that achievable by the foregoing Cook structure.

It should be noted further that Cook, in U.S. Pat. No. 2,929,193, discloses two embodiments for generating a mechanical error signal; i.e., an output shaft whose rate of rotation is an analog of the difference in speeds of the reel and the flyer. These embodiments, however, rely extensively on mechanical drives of the type having gears, teeth or cogs, which are inherently incapable of the fine adjustment required for twisting a precise lay length. Moreover, Cook's differential mechanisms comprise many mechanical parts, e.g., pinions, bevel gears, and a spur gear, which, in addition to introducing sources of error, are power inefficient and more costly than the means disclosed herein.

In order to wind the twisted strands onto the reel in uniform layers, it is important to accurately control the points at which the reciprocating member (reel or flyer) reverses with respect to the reel end flanges. If the reciprocating member does not reverse direction at a point exactly at an end flange of the reel, there will result either an accumulation of wire adjacent to this flange or a shortage of wire (or recess) in the vicinity of the flange. Such accumulations or recesses at the flanges are, of course, undesirable. The Cook patent does not disclose the means used in his stranding machine for controliing the points at which the reciprocating reel reverses. One arrangement well known in the prior art comprises stop or limit switches which are adjusted manually to determine the range of the reciprocating member. However, manual adjustment is time-consuming and requires considerable operator skill. Furthermore, take-up reel dimensions vary greatly, necessitating the readjustment of the stop or limit switches each time a new reel is mounted on the machine. The latter requirement is, of course, disadvantageous in high speed production applications.

U.S. Pat. No. 3,677,483, issued to Henrich, discloses a wire winding apparatus which automatically displaces the limit switches controlling the reversal of a reciprocating pulley 4 so as to obtain uniform layers of wire on a reel. Henrich's apparatus responds to changes in the tension of the wire as being indicative of irregular buildup. In his apparatus, the tension of the wire affects movements of a wire dancer or accumulator. This approach is unsuitable in standing machines wherein no change of wire tension necessarily occurs when the velocity of the wire being drawn into the machine changes due to irregular wire buildup on a reel. Moreover, it would be very difficult to adapt the Henrich apparatus for use in a wire stranding machine instead of the simple winding operation for which it is designed.

This is because, in a stranding machine, both the flyer and the reel are rotating and consequently, there is no convenient means for sensing the wire tension at a point between the flyer and the reel. In contrast, in Henrich's apparatus, only the reel rotates as wire is fed over a non-rotating pulley 13.

The Henrich apparatus suffers from several other disadvantages which are not found in this invention. For one thing, movements of the dancer (pulley 13) can be caused by forces other than changes in wire tension due to irregular buildup. For example, movement may result from variations in the speed of the machine which supplies wire to the dancer.

A second disadvantage of Henrich's apparatus lies in the fact that the dancer movements may be sluggish, and therefore, unresponsive when a heavy mass is involved.

Thirdly, changes in wire tension are often caused by the dancer itself because it is spring-loaded; thus, the spring force may vary with the position of the dancer or with the geometry of the wire path as the dancer moves, thereby introducing spurious variations in wire tension.

A further shortcoming of Henrich's apparatus is that it cannot distinguish between a change in tension due to wire buildup or recess at the reel flange from a change due to other causes away from the reel flanges and unrelated to improper reversal points of the reciprocating pulley.

Lastly, Henrich's apparatus makes an adjustment of an apparently incorrect limit switch position upon sensing the change in tension, without any prior verification of the condition. Moreover, his apparatus does not limit the adjustment to predetermined spaced intervals to allow the limit switch to be moved before another adjustment is initiated. This may result in overcorrection.

As will be seen from the description below, the means for obtaining uniform layering of the wire on the reel, as taught by this invention, does not suffer from any of the foregoing shortcomings and disadvantages of the Henrich apparatus. Thus, it represents a significant advance in the art.

SUMMARY OF THE INVENTION

The present invention comprises three major systems or components. The first is a wire twisting and winding apparatus; the second, an automatic lay length control system; and the third, an automatic wire layering control system (the latter controlling the proper points for reversal of the flyer in its reciprocating motion). The inventioned machine is capable of stranding or twisting wire strands, each of which may be bare or insulated wire, solid wire or twisted wire comprised of smaller strands.

Among the novel features of the wire twisting and winding apparatus are (i) its structure for reciprocating the rotating flyer transversely with respect to the reel; and (ii) its pivotable reel support mechanism for easier removal of the reel when fully loaded with bunched wire. It is the automatic lay length control system component of the present invention which makes feasible the reciprocation of the flyer instead of the reel, and thus, the attainment of the benefits thereof discussed above. By so eliminating the reciprocating reel, the utilization of a pivotable reel support mechanism, in turn, also becomes feasible, with its attendant benefits.

Another novel feature of the wire twisting and winding apparatus is its rotating "closing" die with an adjustable rate of rotation. This enables wire strands which have some degree of temper, and consequently which naturally tend to spring back, to be temporarily overtwisted. By virtue of their tendency to spring back, the temporary overtwist is removed by the time the strands pass through the flyer and the detrimental effects of spring back (e.g., "bird-caging") are substantially eliminated. The result is a smoother wire product than would otherwise be the case. Smoothness in stranded wire is advantageous because it enables the use of thinner insulation over the wire.

The present invention also teaches the use of both a "closing" die and a "forming" die, each rotating at the speed of the flyer. The first die (the closing die) has a lightly fitting opening sufficient to cause the wire to twist as the flyer rotates. The second die (the forming die) has a smaller opening and is used to further compact and smooth the wire.

The lay length control means comprises a lay length error sensing means, which generates a first error signal if the lay length is too short with reference to a selected lay length, or a second error signal if the lay length is too long with reference to the selected lay length. If the actual lay length equals the selected lay length, within a predetermined tolerance, no error signal appears. The error signals drive a servo motor (clockwise or counterclockwise, depending upon whether the lay length is too long or too short) which drives, in turn, an infinitely variable ratio transmission. The infinitely variable ratio transmission (part of the twisting and winding apparatus) couples a main drive shaft, which drives the flyer, to an output shaft which drives the reel. As the ratio of the transmission means is varied by the servo motor, in response to an error signal, the rate of rotation of the reel relative to that of the flyer is changed so as to correct the lay length (and thereby, also to "null" the error signal). As is apparent from the foregoing discussion, the lay length control system of this invention forms part of a closed-loop feedback control system. While such control systems are known in the field, the particular configuration disclosed herein, adapted for use in a wire stranding and bunching machine, has certain novel features. Firstly, the lay length error signals are generated by comparing electrical analogs of the wire velocity and the flyer's rate of rotation, the latter being related to any selected lay length by a unique constant. Thus, error signals are generated, and correction made, both for the lay length errors attributable to (i) wire build-up on the reel (the primary source of error) and (ii) changes in flyer speed due to drive belt wear, among other possible causes (a secondary source of error). This feature of the present invention will be more fully described hereinbelow.

Secondly, the use of an infinitely variable ratio transmission to make the required reel rate of rotation correction achieves far more accurate control of the lay length than that attainable from an adjustable pulley and belt configuration, primarily because it has a wide dynamic range of drive ratios, commensurate with the range of the speed of the reel from its unloaded to its fully loaded states. The generation and use of electrical error signals, suitable for driving a servo motor, enables the use of an infinitely variable ratio transmission in the control loop of the invented machine.

Other features of the automatic lay length control system include (i) means for selecting a desired lay length (in inches or centimeters) from a calibrated dial; (ii) timing means for controlling the interval during which an error signal drives the servo motor (thus providing lay length error correction by one or more "pulsed" inputs to the servo motor); (iii) means for varying the magnitude of the voltage applied to the servo motor during each drive interval; and (iv) timing means of controlling the period between drive pulses to the servo motor (thus, providing time for the system to respond, and sense if further correction is required, before allowing another drive pulse to input the servo motor).

The automatic wire layering control system automatically locates and maintains the correct positions of a pair of limit switches mounted adjacent to a flyer carriage. The flyer carriage, on which the flyer is mounted, is driven reciprocally on slide rails. The limit switches, when activated by the flyer carriage, cause the flyer carriage drive means to reverse the direction of the flyer carriage's traverse.

One novel feature of the foregoing control system lies in the beneficial use which it makes of the lay length error signals, discussed above, to detect whether the position of either limit switch is improper for a particular size reel, causing a wire accumulation or recess, as the case may be. This beneficial use of the error signals is possible because an accumulation of wire on the reel adjacent to a reel figure causes an increase in the velocity of the wire strands being drawn into the machine, while a recess in the wire layers causes a slow-down in the wire velocity. Such changes in wire strand velocity are detected by the lay length control system, discussed above. In response to such changes in the velocity of the incoming wire strands, the lay length control system generates one or the other of the two error signals. Thus, such error signals may be indicative of a wire accumulation or recess due to the improper location of either one or both of the limit switches.

To enable the wire layering control system to distinguish an error signal due to the improper location of a limit switch from one due to normal wire buildup on the reel, the system utilizes (i) left zone and right zone switches, mounted adjacent the flyer carriage drive shaft in close proximity to the corresponding left and right limit switches, and (ii) logic means. The left and right zone switches, when activated by the flyer carriage as it approaches the end of each traverse, provide electrical signals which indicate that the position of the flyer carriage corresponds to a position of the flyer in the vicinity of the left or right reel flanges respectively. The logic means incorporated is configured to be responsive to an error signal, indicating either a wire accumulation or recess, only when and if such signal is detected during the times that the flyer carriage is in either the left or right zone. The logic means stores each occurrence of an error signal and (i) whether it indicates an accumulation or a recess, and (ii) in which zone of the flyer carriage traverse it occurred. After a predetermined number of occurences of a particular error (e.g., an accumulation of wire in the left zone), indicating an incorrect position of a limit switch (in the foregoing example, the left limit switch being too far to the left), the wire layering control system logic outputs a control signal. The control signal caused a pulse of power to be applied to either a left limit switch drive means or a right limit switch drive means, depending upon which limit switch has to be re-positioned to eliminate the wire accumulation or recess. The polarity of the power applied determines the direction in which the limit switch drive means moves the switch.

Thus, it is a principal object of the present invention to provide a single twist wire stranding and bunching machine which can achieve and maintain highly uniform lay lengths automatically, and operate at higher speeds than heretofore possible.

It is another principal object of this invention to provide a machine in which the lighter flyer reciprocates with respect to the wire take-up reel, thereby enabling the utilization of smaller and less expensive bearings and motors, and achieving a substantial reduction in vibration.

A still further object of this invention is to provide a machine which comprises means enabling the relatively easy and inexpensive removal of loaded reels after completion of a wire stranding, twisting and winding cycle.

Yet another object of the present invention is to provide means for automatically locating and maintaining the position of flyer carriage limit (reversing) switches so as to achieve uniform layering of the wire from reel flange to reel flange, notwithstanding the usual variations in the widths of the reels placed on the machine.

Other objects, novel features and advantages of the present invention will become apparent upon making reference to the following detailed description and the accompanying drawings. The description and the drawings will also further disclose the characteristics of this invention, both as to its structure and its mode of operation. Although preferred embodiments of the invention are described hereinbelow, and shown in the accompanying drawing, it is expressly understood that the descriptions and drawings thereof are for the purpose of illustration only and do not limit the scope of this invention.

DETAILED DESCRIPTION OF THE INVENTION

TWISTING AND WINDING APPARATUS

Figure 1:
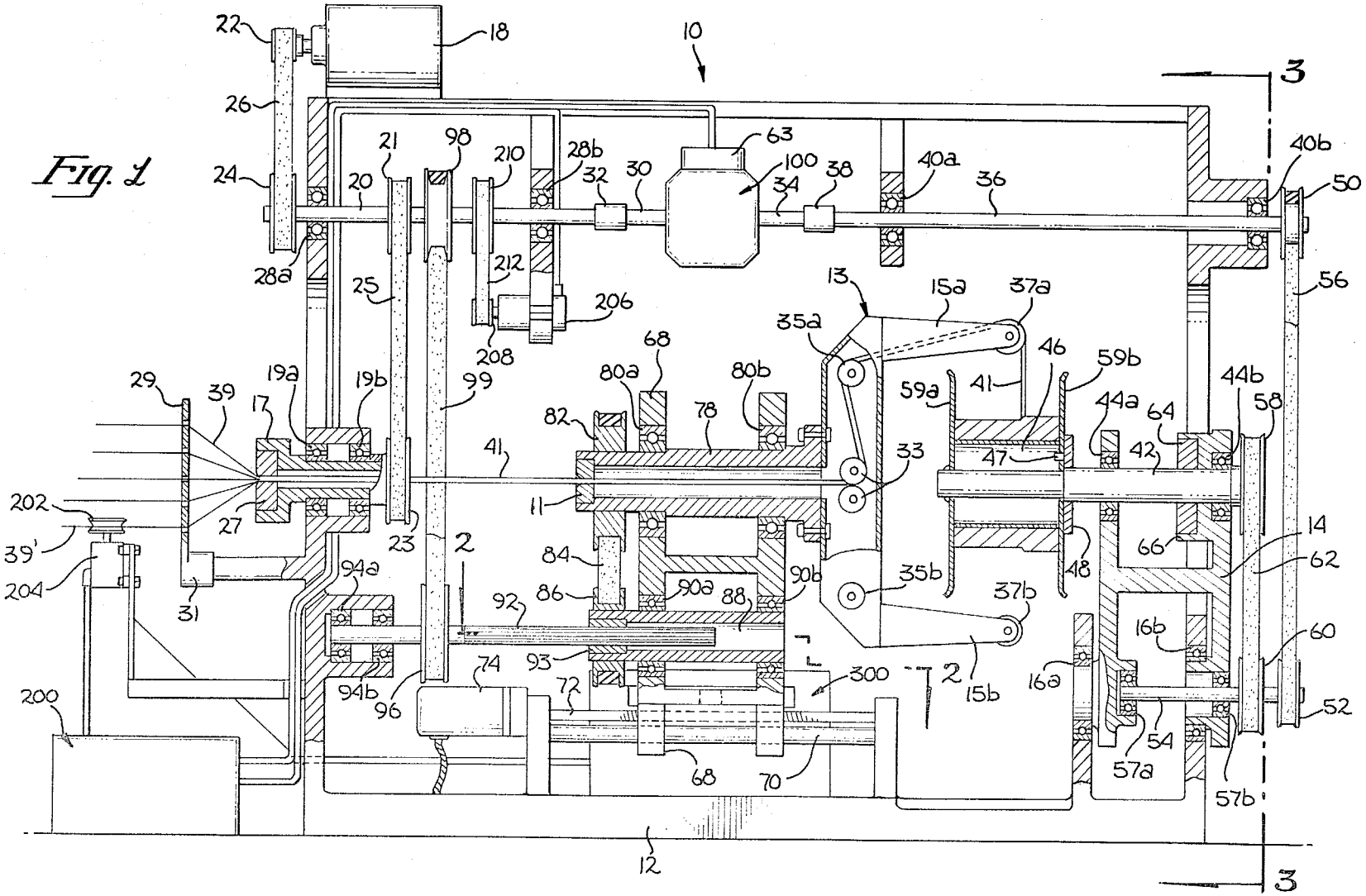
FIG. 1 is a side elevation view of the present invention showing, in particular, the wire twisting and winding apparatus.

With reference to FIG. 1, a wire twisting and winding apparatus 10 is now described in detail. It comprises a main frame 12 and a pivot frame 14 supported on the main frame 12 by pivot bearings 16*a* and 16*b*. The pivot frame 12 is shown in its vertical or operating position in FIG. 1 and in its horizontal position (for reel removal) in FIG. 3.

A main drive 18, typically but not necessarily an electric motor, is coupled to a main input shaft 20 by means of pulleys 22 and 24 mounted on the output shaft of main drive 18 and input shaft 20 respectively, and an interconnecting drive belt 26. It is noted that input shaft 20 need not be driven positively. Therefore, drive belt 26 may be of the v-belt or flat belt types, or their equivalents. However, all other drive belts utilized in this invention, and identified below, must be of the positive drive type, therefore employing belts of the "toothed" or "timing-belt" varieties.

The input shaft 20 is rotatably supported on bearings 28*a* and 28*b*, mounted in main frame 12 and coupled to an input shaft 30 of a variable ratio drive 100 (described in detail below) through conventional shaft coupling means 32. An output shaft 34 of the variable ratio drive 100 is coupled to a reel shaft 36 through a second coupling means 38. Bearings 40*a* and 40*b*, mounted in main frame 12, rotatably support the reel shaft 36 within the main frame. In order to maintain a uniform lay length while the effective diameter of the reel (i.e., the diameter of the reel with wire wound thereon) increases, the ratio of the speed of main input shaft 20 to reel shaft 36 must be continually changed as the apparatus 10 operates. This is accomplished automatically by means of a lay length control system 200 (described in detail below), operating in conjunction with the variable ratio drive 100 which variably couples the reel shaft 36 to the main input shaft 20.

A reel spindle 42 is rotatably supported on bearings 44*a* and 44*b* which are mounted in pivot frame 14. The outboard portion of reel spindle 42 supports a reel 46, the reel having an aperture therein adapted to receive a dog pin 47. Dog pin 47 is attached to a dog plate 48 which is secured to reel spindle 42, so that reel 46 may be either driven or braked by the reel spindle 42. The drive of reel spindle 42 is accomplished by coupling the torque of reel shaft 36 to reel spindle 42 as follows: a pulley 50 is mounted on reel shaft 36 and coupled to a pulley 52 mounted on a reel jack-shaft 54 by an interconnecting drive belt 56; reel jack-shaft 54 is rotatably supported in bearings 57*a* and 57*b* mounted in pivot frame 14; a pulley 58 is mounted on reel spindle 42 and coupled to a pulley 60 mounted on jack-shaft 54 by an interconnecting drive belt 62. Thus, by means of the foregoing pulley and belts, reel shaft 36 drives reel spindle 42.

Figure 3:
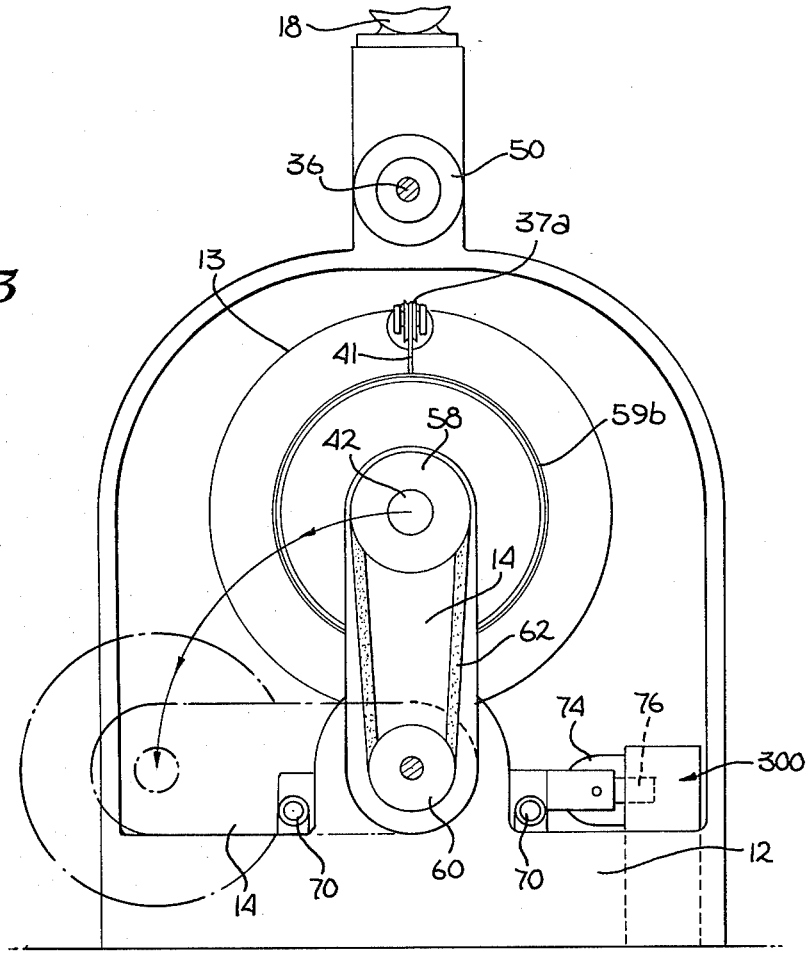
FIG. 3 is a cross-section view of the apparatus of FIG. 1 taken along the lines 3—3.

Bearings 57*a* and 57*b* are in coaxial alignment with pivot bearings 16*a* and 16*b*; therefore, when the pivot frame 14 is pivoted to its horizontal position, as shown in FIG. 3, the centers of pulleys 52 and 60 remain fixed. This feature permits the pivot frame 14 to be pivoted for reel removal by hydraulic or other means (not shown) without removing or adjusting drive belts 56 or 62.

A conventional brake assembly, comprising a rotating member 64 attached to the reel spindle 42 and a stationary member 66 mounted on pivot frame 14, is used for braking the reel spindle and the reel 46 mounted thereon. Actuation of the rotating member 64; to cause it to engage the stationary member 66, can be accomplished manually or automatically by means well known in the art.

Figure 2:
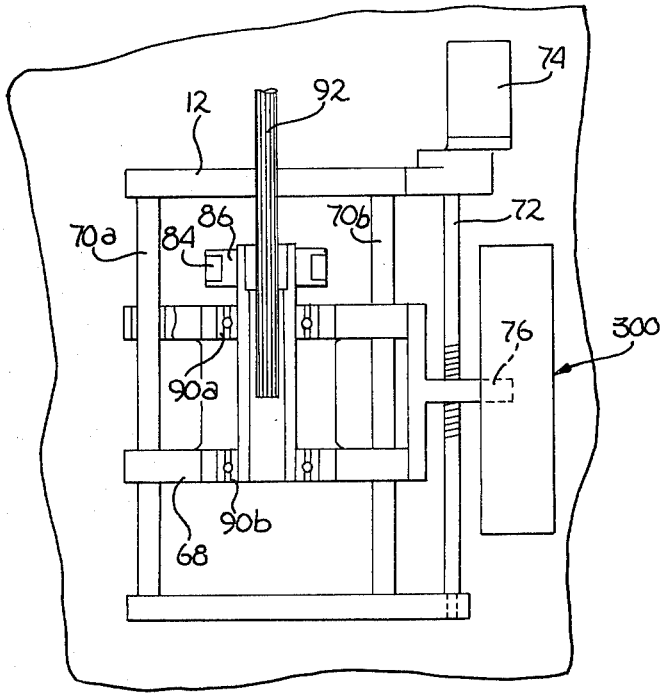
FIG. 2 is a cross-sectional view of the apparatus of FIG. 1 taken along the lines 2—2.

Referring now to FIG. 2 (in addition to FIG. 1), a flyer carriage 68 is described. The flyer carriage 68 is slidably mounted on slide rails 70*a* and 70*b* mounted in main frame 12. A reversing screw 72 driven by drive means 74, typically comprising an electric motor, engages a threaded member 76 secured to the flyer carriage 68. As a result, when the motor 74 is driven, the carriage 68 is caused to travel along the slide rails 70 by the force of the threading operation of screw 72 through threaded member 76. An automatic wire layering control system 300, which will be described in detail below, controls the positions of limit switches which alternately reverse motor 74 at the appropriate time, causing the flyer carriage 68 to traverse back and forth on the slide rails 70 over a distance corresponding to the distance between the flanges 59*a* and 59*b* of reel 46. In a typical application, drive means 74 comprises an electric motor operating at 1600 rpm. This is reduced by a 5 to 1 ratio by conventional means, so that reversing screw 72 rotates at 300 rpm. The pitch of threaded member 76 is ¼ inch per revolution; thus, the flyer carriage 68 reciprocates at about 75 inches per minute.

Flyer shaft 78 is rotatably supported, coaxially with reel spindle 42, on the flyer carriage 68 in bearings 80*a* and 80*b* mounted in the carriage. A pulley 82 is mounted on the flyer shaft 78 and driven by a drive belt 84 coupled to a pulley 86. Pulley 86 is, in turn, attached to a spline jack-shaft 88, which is rotatably supported by bearings 90*a* and 90*b* mounted on flyer carriage 68. The spline jack-shaft 88 is hollow to accept a spline shaft 92 coaxially within its interior space, and has a spline nut 93 secured in its open end to transmit torque to it from spline shaft 92. The spline shaft 92 is rotatably supported in bearings 94*a* and 94*b* mounted in the main frame 12. Spline shaft 92 is driven by means of pulley 96 mounted thereon, pulley 98 mounted on the input shaft 20 and drive belt 99 interconnecting said pulleys 96 and 98. The spline shaft 92 slidably engages the spline nut 93 throughout each stroke of the flyer carriage 68.

Flyer shaft 78 has a coaxial hole extending through its entire length with a counter-sink at one end to accept a forming die 11. A flyer 13, having hollow flyer arms 15*a* and 15*b*, is secured to the end of the flyer shaft 78 opposite the forming die 11, so that the flyer 13 and the flyer shaft 78 reciprocate with flyer carriage 68, and concurrently rotate together within bearings 80*a* and 80*b*. The function of forming die 11, mounted in the flyer shaft 78, is discussed more fully below in conjunction with the description of the operation of the apparatus 10.

At the front end of the twisting and winding apparatus 10, a die shaft 17 is rotatably supported within main frame 12, coaxially with flyer shaft 78, by means of bearings 19*a* and 19*b* mounted in said main frame. A pulley 21, mounted on the input shaft 20, drives a pulley 23 mounted on the die shaft 17 by means of interconnecting drive belt 25. Die shaft 17 has a coaxial hole extending through its entire length and a counter-sink at one end to receive a closing die 27. The closing die 27 has an aperture and profile suitable for imparting a twist to a grouped (or "bunched") plurality of wire strands 39 fed through it, with one twist for each revolution of the flyer 13.

A spider plate 29 is used to group or bunch the plurality of wire strands 39 coming from "payoff" reels (not shown), prior to their being fed through closing die 27. The spider plate 29, having a plurality of openings, is disposed in front of die shaft 17 and affixed to the main frame 12 by mounting bracket 31. (Hereafter, the wire strands 39, after being bunched and passed through closing die 27, are designated by the numeral 41).

Figure 4:
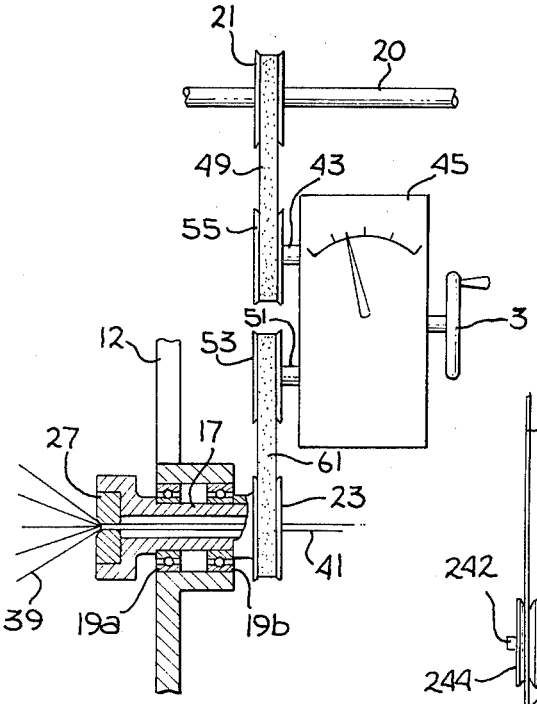
FIG. 4 is a side elevation view of a second embodiment of means for rotating the closing die at the front end of the wire twisting and winding apparatus.

With reference to FIG. 4, a second embodiment of the rotating closing die configuration, adapted to selectively enable some overtwisting of the wire bunch 41, is now described. As background, it should be noted that, in order for the individual wire strands 39 to conform to a geometrically helical form in the bunched condition, they have to be very pliable. Thus, for example, when wire strands 39 are copper, they must be fully annealed. If, consequently, the individual wire strands 39 have some degree of temper, they will tend to move out of place, i.e., to spring back, after being bunched and twisted. This results in an unsmooth, and therefore, lower quality product.

In order to overcome this problem, the present invention teaches the rotation of closing die 27 at a rate which causes a temporary overtwist in the wire bunch 41. This overtwist is then removed by the natural springback of the individual strands 39 by the time they reach the forming die 11, which is rotating at the proper rate; i.e., the rotational rate of the flyer 13. To accomplish the foregoing optimally, the rotational rate of die 27 must be adjusted to cause an amount of overtwist which matches the actual temper and springback characteristic of the particular wire strands 39 being bunched and twisted. Thus, instead of the fixed drive means described above, i.e., pulleys 21 and 23 and interconnecting drive belt 25, a variable drive means is disclosed.

The input shaft 20 is coupled to the input shaft 43 of a variable ratio transmission 45 by means of pulley 55 mounted on shaft 43, pulley 21 on main input shaft 20 and interconnecting drive belt 49. The output shaft 51 of the variable ratio transmission 45 is coupled to the die shaft 17 by means of pulley 53 mounted on shaft 51, pulley 23 on die shaft 17 and interconnecting drive belt 61. Variable ratio transmission 45, adjustable by selection means 3 (shown symbolically as a handwheel in FIG. 4), selectively determines the rate of rotation of the die shaft 17 as a function of the rotational rate of the main input shaft 20. The selected transmission ratio is that which over-drives the die shaft 17 so as to cause the correct amount of overtwisting of wire bunch 41. This proper transmission ratio may be determined by calibrating the selection means 3 for various wire materials and/or by trial and error prior to the commencement of a production run. Variable ratio transmissions are known and available in the trade. Suitable ones for this invention can be obtained from the Link-Belt Division of the FMC Corporation.

With reference again to the flyer 13 and FIG. 1, a pair of throat pulleys 33 are mounted in alignment with the hollow center of the flyer shaft 78. Throat pulleys 33 are adapted to receive the bunched wire strands 41, which are passed through the hollow center of the flyer shaft 78, and to direct them either to a flyer pulley 35*a* mounted on flyer arm 15*a*, or to a second flyer pulley 35*b* mounted on opposite flyer arm 15*b*. Flyer pulleys 35*a* and 35*b* direct the wire 41 to the ends of flyer arms 15*a* and 15*b* respectively, as the case may be. Mounted at the extreme ends of flyer arms 15*a* and 15*b* are flyer arm pulleys 37*a* and 37*b* respectively. The arm pulleys 37*a* or 37*b*, in turn, direct the wire 41 downwardly to the reel 46, as the case may be. If a left-handed twist, the standard twist in the trade, is desired, the wire 41 is directed through the hollow center of the flyer shaft 78, between the throat pulleys 33 to flyer pulley 35*a*, and thence to flyer arm pulley 37*a*. If a right-handed twist is desired, the wire 41 is directed through the throad pulleys 33 and over flyer pulley 15*b* to arm pulley 37*b*. Moreover, the direction of rotation of the flyer shaft 78 and the reel shaft 46 are likewise reversed electrically by means well known in the machinery field.

OPERATION

Having described the essential structural configuration of twisting and winding apparatus 10 (except for the variable drive ratio 100 which is described below in conjunction with the control of the wire's lay length), the operation of the wire twisting and winding apparatus 10 is now described.

A plurality of individual wire strands 39, fed from payoff reels (not shown), pass through corresponding openings in spider plate 29 and are bunched thereby prior to being drawn into closing die 27. The bunched wire 41 has a twist imparted to it by the rotation of closing die 27 (one twist for each revolution of the flyer 13).

After emerging from the closing die 27, the bunched wire 41 is passed through the coaxial hollow interior of the die shaft 17 and out the opposite end thereof. The wire 41 is next passed through the forming die 11 and the coaxial hollow interior of the flyer shaft 78 from which they emerge. Forming die 11 may either have (i) an aperture and profile suitable for further compacting the bunched wire 41, reducing its outside diameter and making it smoother; or (ii) a looser aperture so that the die serves primarily as a wire guide. Forming die 11 rotates and reciprocates with the flyer shaft 78, thereby reducing its internal wear, inasmuch as the angular position of the bunched wire strands 41 within it is constantly changing. As a result, the life of the die 11 is beneficially extended.

After passing through the coaxial hollow interior of the flyer shaft 78, the wire 41 then passes through the flyer 13, and more specifically, through the flyer's throat pulleys 33, over flyer pulley 35*a*, through the hollow flyer arm 15*a* and over arm pulley 37*a* which directs it downward for winding onto reel 46. Wire 41 is wound onto the reel 46 at a point approximately opposite the edge of arm pulley 37*a*. It is distributed longitudinally across the internal width of the reel 46, between reel flanges 59*a* and 59*b*, by virtue of the reciprocating motion of the flyer 13 (affixed to the reciprocally traversing flyer carriage 68). Even layering of the wire 41 on the reel 46 is achieved by the automatic layering control system 300, described in detail below.

When the reel 46 is fully wound with wire 41, the power to the main drive means 18 is turned off and brake rotating member 64 is caused to engage the brake stationary member 66, thereby braking the reel's rotational motion until it is stopped. At this time, loaded reel 46 is ready for removal from reel spindle 42.

The above-described embodiment of the present invention contemplates the use of a reel 46 of the "overhung spindle" type, which is the type most suitable for reels with large bores (e.g., 10–11 inches). An overhung spindle type reel is held to the spindle only on one side thereof (see dog pin 47 and dog plate 48 in FIG. 1). This is in contrast with a "pintle" type reel, (suitable for reels with small bores) which requires support at both ends of the spindle. To remove an overhung spindle reel, such as reel 46, the reel must be pushed off the spindle 42, or the spindle withdrawn from it. To do this in apparatus 10, the pivot frame 14, supporting the reel 46, is first rotated approximately 90° from its vertical, or operational, position to a horizontal, or unloading position, in the manner shown in FIG. 3 by hydraulic or other power means (not shown). In the unloading position, the reel 46 is substantially at floor level and, thus, can be readily ejected off the spindle 42 and rolled away from the machine. It should be noted from FIG. 3 that, in its unloading position, reel 46 is fully or substantially outside the circle circumscribed by the arms of flyer 13. The foregoing reel removal means is superior to that found in machines of the prior art from which the reel is removed while still in its operational position, concentric with the flyer and within the circle circumscribed by the flyer arms. As indicated earlier, the latter require the use of expensive and time-consuming overhead hoist means. It should be apparent that loading of an empty reel onto the spindle is done in the above-described sequence in reverse.

LAY LENGTH CONTROL AND THE VARIABLE RATIO DRIVE

A very important component of the wire twisting and winding apparatus 10 is the variable ratio drive 100. As indicated above, the purpose of variable ratio drive 100 is to provide the means for continually adjusting the rate of rotation of the reel shaft 36 with respect to the fixed rate of rotation of main input shaft 20. The purpose of such continual adjustment of the speed of reel shaft 36 is to maintain a uniform lay length, within a predetermined tolerance, as will become apparent from the following discussion.

Each rotation of the flyer 13 results in a single twist; consequently, the lay length, or length of wire 41 having one twist, is equal to the length of the wire wound onto the reel 46 during each flyer revolution. The length of wire wound onto the reel 46 during each revolution of flyer 13 is determined by the difference between the rate of rotation of the flyer 13 and that of the reel 46. While the wire 41 can be wound either by the flyer 13 rotating faster than reel 46, or vice versa, it is more advantageous to operate the reel 46 at a rotational rate slower than that of the flyer 13. This is because of the inherent imbalance which develops in the reel 46 as it fills up with wire. Operating the reel 46 at a slower rotational rate than that of the flyer 13 is often referred to in the trade as being "underdriven". While the embodiment described herein operates in an "underdriven" mode, the structure and principles disclosed herein are equally applicable to an "overdriven" mode of operation.

As the flyer makes one revolution, the reel 46 makes less than one revolution. Thus, a length of wire 41 is pulled into the apparatus 10 which equals that portion of the circumference of the instantaneous wire fill on the reel 46 corresponding to that portion of one revolution by which the reel 46 lags behind the flyer 13. For example, suppose the reel's rate of rotation is 90% that of the flyer 13, and the instantaneous effective diameter of the reel 46 is 12 inches. The circumference of the instantaneous wire fill is, therefore, $12\pi$ or approximately 37.7 inches. Inasmuch as the reel 46, during the period of each flyer 13 revolution, lags behind the flyer by 10%, one-tenth of the circumference of the instantaneous wire fill will be drawn into the apparatus 10 and wound onto the reel 46 during each such period. Thus, the length of wire 41 drawn and wound during each flyer revolution, in this example, would be 10%×37.7 inches or 3.77 inches. Since this length of wire entered the apparatus 10 during one revolution of the flyer 13, it will have one twist in it, and therefore, will have a lay length of 3.77 inches.

The above-described relationships can be expressed mathematically as follows:

$$L = \frac{|F - R|}{F} \pi D, \tag{1}$$

where

L is the lay length (inches);

D is the instantaneous effective diameter of the reel (inches);

F is the rotational rate of the flyer (rpm); and

R is the rotational rate of the reel (rpm).

$\pi$ is the ratio of the circumference to the diameter of a circle (equal to 3.14 . . . ).

By introducing a speed ratio K, where K=R/F (dimensionless), and substituting K in equation (1), the following equation results:

$$L=|1-K|\pi D \tag{2}$$

As pointed out earlier, the effective diameter D of the reel 46 continually increases as wire 41 is wound thereon. Thus, in order to achieve a constant or uniform lay length L, equation (2) indicates that the ratio of reel to flyer speed K must correspondingly increase from less than 1, in an underdriven operation, toward 1. Adjustment of the ratio of reel to flyer speed K is accomplished by adjusting the rate of rotation of the reel 46. Further, inasmuch as the ratio K must continually increase toward 1, as wire 41 builds up on the reel 46, the required adjustment of the reel's rotation rate must be to continually increase it. This requirement may also be viewed and understood another way: as the circumference of the instantaneous wire fill increases, the reel 46 need lag less behind the flyer 13 in order to draw in a fixed length of wie 41 during a single flyer revolution.

The foregoing can be illustrated by continuing the earlier example in which (i) a lay length of 3.77 inches was desired; and (ii) the reel speed was 90% that of the flyer when the instantaneous effective reel diameter was 12 inches. At a later time, suppose the effective diameter of the reel has increased to 15 inches. If a constant lay length of 3.77 inches is to be maintained, the reel speed will have had to have increased to 92% of the flyer speed. This becomes evident by application of equation (2), as follows:

$$L=3.77=|1-K|\pi D=|1-K|\pi 15$$

By solving for K, K=0.92. In a typical application, the flyer's rotational rate is 2,000 rpm. Thus, for a lay length of 3.77 inches, when the effective reel diameter is 12 inches (which may occur when the reel is lightly loaded), the reel's rotational rate is 90%×2,000, or 1,800 rpm. However, as the effective diameter increases to 15 inches the reel's rotational rate correspondingly increases to 92%×2,000, or 1,840 rpm.

Figure 5:
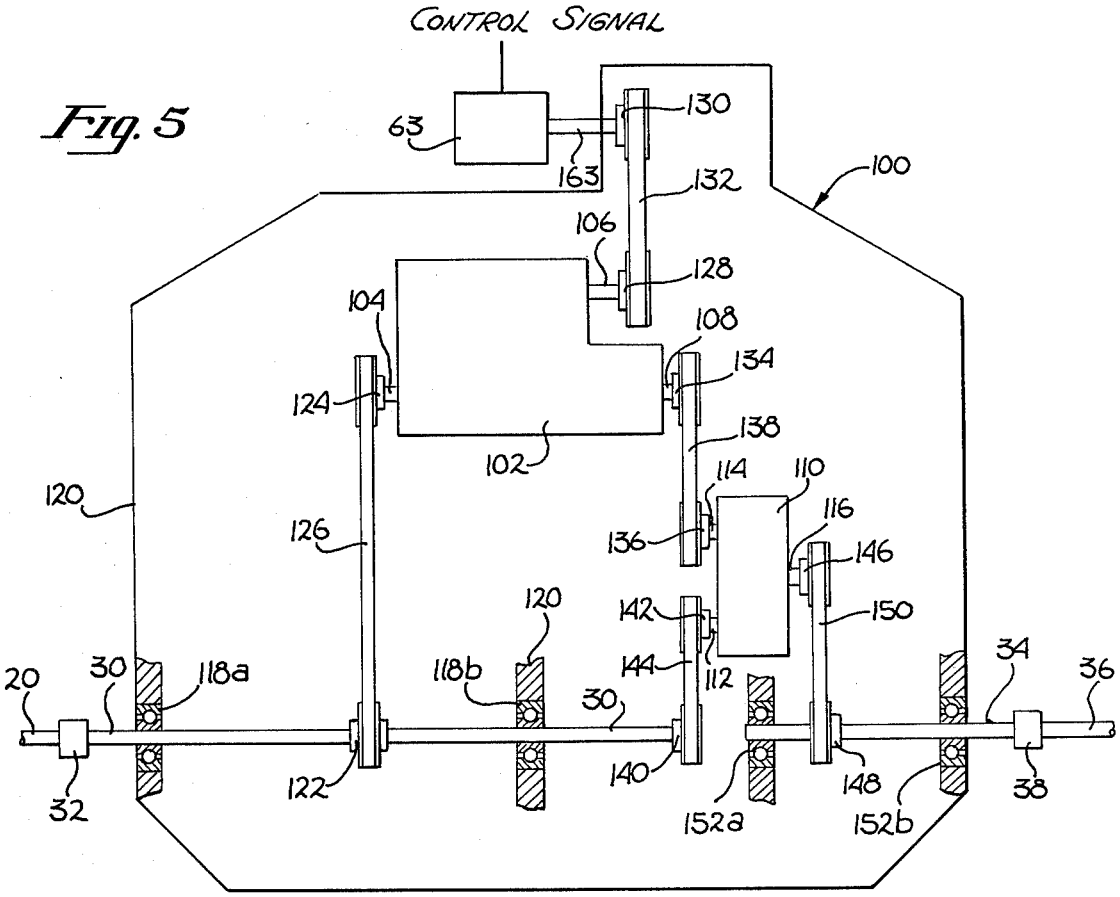
FIG. 5 is a side elevation view of the variable ratio drive means portion of the wire twisting and winding apparatus.

With the foregoing as background, a preferred embodiment of the variable ratio drive 100 is now described in detail with reference to FIG. 5.

The variable ratio drive 100 comprises (i) an infinitely variable transmission 102 having an input shaft 104, a control transmission 110 having first and second input shafts 112 and 114 respectively, and an output shaft 116. As described earlier, the main input shaft 20 of twisting and winding apparatus 10 is coupled to input shaft 30 of the variable ratio drive 100 by coupling means 32. Drive input shaft 30 is rotatably supported on bearings 118*a* and 118*b* which are mounted to housing 120 of variable ratio drive 100.

Drive input shaft 30 is coupled to, and drives, input shaft 104 of the infinitely variable transmission 102 by means of pulley 122 mounted on shaft 30, pulley 124 mounted on input shaft 104 of the transmission 102 and interconnecting drive belt 126. The control shaft 106 of infinitely variable transmission 102 is coupled to the output shaft 163 of servo motor 63 by means of sprockets 128 mounted on the control shaft 106, sprockets 130 mounted on servo output shaft 163 and interconnecting drive chain 132.

The output shaft 108 of infinitely variable transmission 102 is coupled to one of the two inputs, 114, of differential transmission 110 by means of pulley 134 mounted on shaft 108, pulley 136 mounted on said input shaft 114 and interconnecting drive belt 138. The first input shaft 112 of differential transmission 110 is coupled to the drive input shaft 30 by means of pulley 140 mounted on shaft 30, pulley 142 mounted on shaft 112 and interconnecting drive belt 144. The output shaft 116 of differential transmission 110 is coupled to the drive input shaft 30 by means of pulley 146 mounted on shaft 116, pulley 148 mounted on shaft 34 and interconnecting drive belt 150. Drive output shaft 34 is rotatably supported on bearings 152*a* and 152*b* which are mounted to drive housing 120. As indicated earlier, the drive output shaft 34 is coupled to the reel shaft 36 of the twisting and winding apparatus 10 by coupling means 38.

Infinitely variable transmissions, servo motors and differential transmissions are known and available in the trade. Among the specific kinds of each which are suitable for use in this embodiment of variable ratio drive 100 are the following: (i) for the infinitely variable transmission, a "PIV" unit sold by the Link-Belt division of the FMC Corporation; (ii) for the servo motor, a "gearhead" sold by Bodine Company of Chicago, Illinois, and (iii) for the differential transmission, a "3-bore" differential transmission sold by Fairchild Industrial Products of North Carolina.

Having described the configuration of infinitely variable transmission 100, its operation is now described. The rotational rate of output shaft 108 of the infinitely variable transmission 102 ($r_{108}$) is a function of both the rotational rate of its input shaft 104 ($r_{104}$) and the position of control shaft 106 ($P_{106}$). Thus, $$r_{108}=c_1 r_{104} P_{106} \tag{4}$$

where $c_1$ is a first constant.

Inasmuch as input shaft 104 of transmission 102 is fixedly coupled to main input shaft 20, its rotational rate is directly proportional to the rotational rate of input shaft ($r_{20}$). Thus, $$r_{104}=c_2 r_{20}, \tag{5}$$

where $c_2$ is a second constant. Thus, $$r_{108}=c_1 c_2 r_{20} P_{106} \tag{6}$$

Moreover, the flyer's rotational rate F is also directly proportional to the rotational rate of main input shaft 20 to which is is fixedly coupled, as described above. Thus, $$F=c_3 r_{20}, \tag{7}$$

where $c_3$ is a third constant.

The rotational rate of the output shaft 116 of differential transmission 110 ($r_{116}$) equals the difference between the rotational rates of its two input shafts 112 and 114 ($r_{112}$ and $r_{114}$ respectively). Thus, $$r_{116}=c_4(r_{112}-r_{114}), \tag{8}$$

where $c_4$ is a fourth constant.

It is noted that input shaft 114 of differential transmission 110 is coupled directly to the output shaft 108 of infinitely variable transmission 102. Thus, $$r_{114}=c_5 r_{108}, \tag{9}$$

where $c_5$ is a fifth constant.

Inasmuch as the second shaft 112 of differential transmission 110 is fixedly coupled to main input shaft 20, its rotational rate is also directly proportional to the rotational rate of input shaft 20. Thus, $$r_{112}=c_6 r_{20}, \tag{10}$$

where $c_6$ is a sixth constant.

Lastly, the output shaft 116 of differential transmission 110 is coupled to the reel spindle 42, in the manner described above. Thus, $$R=c_7 r_{116}, \tag{11}$$

where R is the reel's rotational rate and $c_7$ is a seventh constant.

From the discussion of lay length control, and equation (2), it is known that the ratio of R/F (K) is a critical parameter. From the foregoing equations, K is determined as follows:

$$K=\frac{c_7 r_{116}}{c_3 r_{20}}=\frac{c_7 c_4(r_{112}-r_{114})}{c_3 r_{20}} \tag{12}$$

$$K=\frac{c_7 c_4(c_6 r_{20}-c_5 r_{108})}{c_3 r_{20}}=\frac{c_7 c_4 c_6}{c_3}\left(1-\frac{c_5 r_{108}}{c_6 r_{20}}\right) \tag{13}$$

$$K=C_1\left(1-\frac{c_5 c_1 c_2 r_{20} P_{106}}{c_6 r_{20}}\right), \tag{14}$$

where $C_1$ is a constant equal to $\frac{c_7 c_4 c_6}{c_3}$ $$K=C_1\left(1-\frac{c_5 c_1 c_2}{c_6}P_{106}\right)=C_1(1-C_2 P_{106}) \tag{15}$$

where $C_2$ is a constant equal to $\frac{c_5 c_1 c_2}{c_6}$.

It is, therefore, seen from equation (15) that the critical parameter K is determined entirely by the variable position of control shaft 106 of infinitely variable transmission 102. Thus, by properly adjusting said control shaft 106, the ratio of reel speed to flyer speed K can be changed in a controlled manner so as to maintain any selected lay length substantially uniform, regardless of wire buildup on the reel 46 or other source of lay length error. This is accomplished by the automatic lay length control system 200, described below, which energizes the servo motor 63 in such a manner as to cause it to drive the control shaft 106 in the direction and by the amount required to maintain the selected lay length.

The combination of a differential transmission 110 and infinitely variable transmission 102, as above described, for variable ratio drive 100 provides a very high resolution control, resulting in very uniform lay length in the wire produced. This is particularly advantageous for very short lay lengths where control is most difficult and critical. A further advantage of this configuration of variable ratio drive 100 is that only a relatively small portion of the horsepower required to drive the reel shaft 36, and ultimately the reel spindle 42 (approximately 10% thereof), is transmitted to the infinitely variable transmission 102 via pulleys 122 and 124, and belt drive 126. Thus, infinitely variable transmission 102 may be a relatively small sized and less expensive unit.

LAY LENGTH CONTROL SYSTEM

Figure 7:
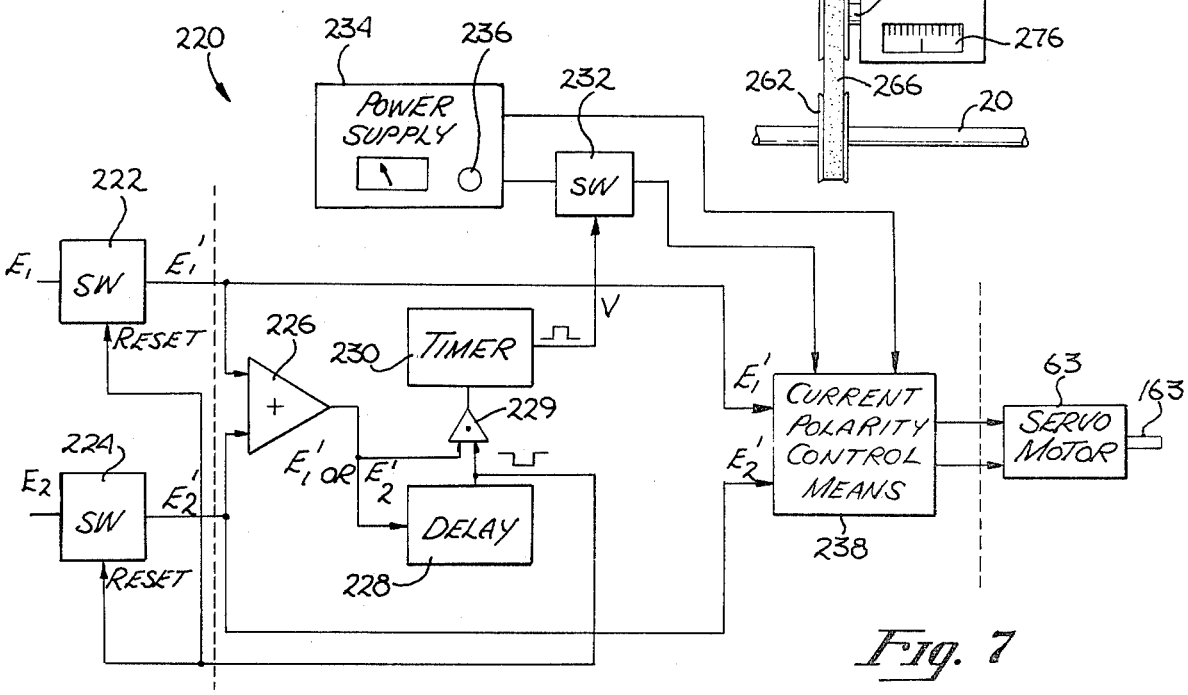
FIG. 7 is a schematic representation of the servo control circuits within the lay length control system.
Figure 6:
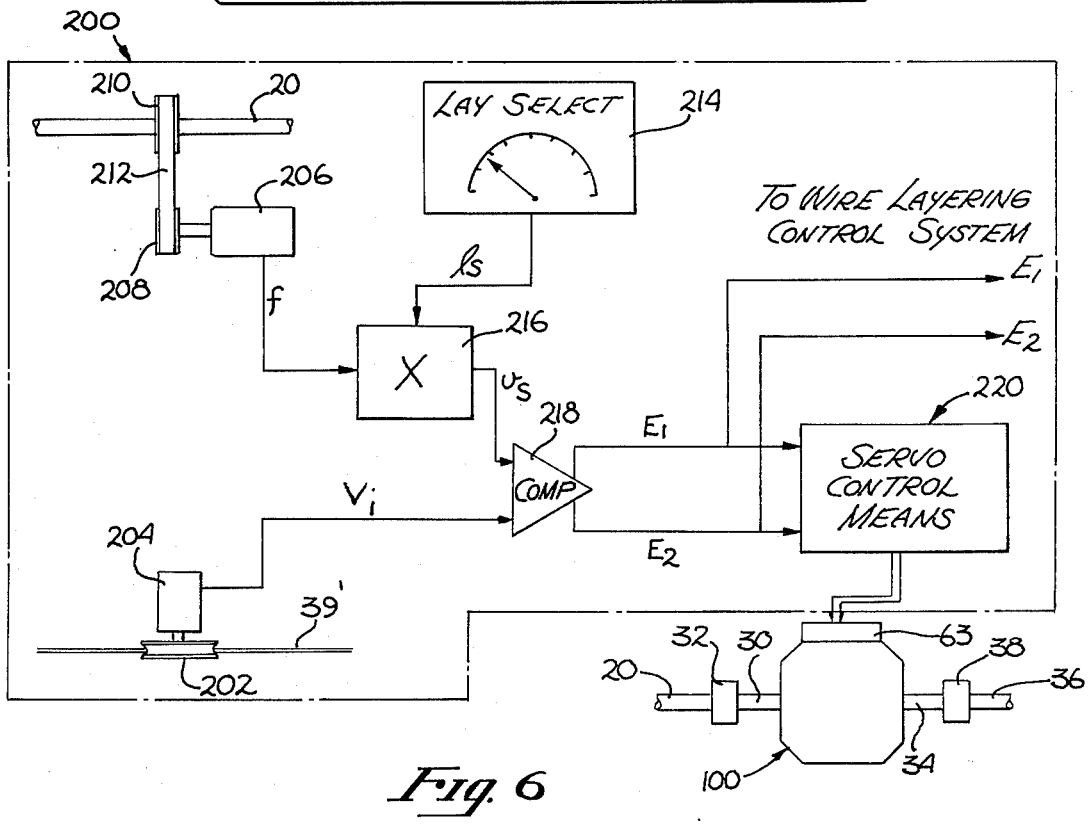
FIG. 6 is a schematic representation of the automatic lay length control system portion of the present invention.

With reference to FIGS. 6 and 7, a preferred embodiment of the automatic lay length control system 200 is now described in detail.

The purpose of lay length control system 200 is to provide one of a sequence of control signals, of the appropriate polarity, to servo motor 63, so as to cause the latter's output shaft 106 to step clockwise or counter-clockwise a pre-determined number of degrees. As discussed above, by so adjusting the position of said output shaft, the ratio of reel to flyer speed K is changed to the extent required to maintain a uniform lay length.

It should be understood that the instantaneous lay length of the wire being drawn into the apparatus 10, $L_i$, during each revolution of the flyer 13, is related to the instantaneous lineal velocity, $V_i$, of the wire strands 39 and the flyer speed. Thus, $$L_i = V_i\left(\frac{\text{inches}}{\text{min.}} \times \frac{1}{F}\left(\frac{\text{min.}}{\text{rev.}}\right) = \frac{V_i}{F}\left(\frac{\text{inches}}{\text{rev.}}\right), \quad (16)$$

where F is the flyer rate of rotation (rpm).

If the instantaneous lay length $L_i$ equals (or is within a predetermined tolerance from) a selected lay length $L_s$, then, $$L_s = V_s/F, \quad (17)$$

where $V_s$ is the correct lineal velocity of the wire required to attain the selected lay length.

Solving equation (17) for the correct lineal wire velocity, $$V_s = L_s F. \quad (18)$$

Thus, it is the object of the lay length control system 200 to adjust the ratio of reel to flyer speed, K, so as to cause the instantaneous lineal wire velocity $V_i$ to equal (or be within a predetermined tolerance from) the required lineal wire velocity $V_s$.

To do so, the control system 200 generates an error signal, E, whenever the difference between the instantaneous wire velocity, $V_i$, and the required wire velocity, $V_s$, exceeds a predetermined tolerance, t. Thus, control system 200 comprises means for (i) sensing the instantaneous lineal wire velocity $V_i$, (ii) determining the required lineal wire velocity $V_s$ for a selected lay length; and (iii) comparing $V_i$ and $V_s$ to determine whether they are within the predetermined tolerance t.

In order to sense the instantaneous lineal wire velocity, an individual wire strand 39' is wrapped around, or otherwise contacts and drives, a pulley 202 mounted on the input shaft of an electric generator 204. Wire strand 39' is preferably one that will be in the center of the twisted group 41. The generator 204 is mounted to frame 12 of the apparatus 10. A preferred generator 204 is the D.C. generator, type "5PY", made by General Electric.

The output of generator 204 is an electric signal, $v_i$, which is an electrical analog of the instantaneous lineal velocity $V_i$ of the wire strand 39'. (The word "analog" as used hereinafter is to be understood broadly to mean an "analogous representation" of the physical characteristic being sensed, e.g., the instantaneous lineal velocity $V_i$, and shall not be interpreted to preclude a digital or discrete electrical signal.)

In order to determine the lineal wire velocity $V_s$ required to achieve a selected lay length $L_s$, equation (18) indicates that the flyer speed F must be multiplied by the selected lay length $L_s$. In the lay length control system 200, this is accomplished by multiplying electric analogs of F and $L_s$, namely f and $l_s$ respectively.

To generate an electric analog f of the flyer speed F, a generator 206, mounted to frame 12, is coupled to the main input shaft 20 by means of a pulley 208 mounted on the input shaft of generator 206, a pulley 210 mounted on shaft 20 and interconnecting belt 212. Inasmuch as main input shaft 20 drives the flyer 13 as well as generator 206, the output of the generator 206 is an electric signal, f, which is an electrical analog of the flyer speed F. A preferred generator 206 is a D.C. generator of the same type as used for generator 204.

A lay select means 214 is provided which enables the manual selection of any lay length within a calibrated range (in inches or centimeters). Lay select means 214 may be a conventional rheostat adapted to output a voltage $l_s$ which is an electrical analog of the selected lay length.

Analog signals f and voltage $l_s$ are electrically connected from the outputs of generator 206 and lay select means 214 respectively to two input terminals of an electrical multiplier means 216, the output of which is the product $f \times l_s$, or $v_s$, where $v_s$ is an electrical analog of the required lineal wire velocity $V_s$ associated with the selected lay length. Suitable electrical multipliers are known and available in the trade. However, depending upon the ratio of the diameters of pulleys 210 and 212, and any difference in the response characteristics of generators 204 and 206, the calibration of lay select means 214 may require a reduction of electrical analog $v_s$. In such event, multiplier means 216 may be an electrical divider, i.e., a multiplier by a number less than one. A suitable electrical divider is a potentiometer across which the electrical analog f would appear. The output would be taken from the movable contact, the position of which would be determined by the magnitude of electrical analog $l_s$.

The electric (analog) signals $v_i$ and $v_s$ are electrically connected from the outputs of generator 204 and multiplier means 216 respectively to two input terminals of a conventional electric comparator means 218. Comparator means 218 provides either (i) a first error signal $E_1$ at a first output terminal thereof when the magnitude of signal $v_s$ is less than that of signal $v_i$ by more than predetermined tolerance, t; or (ii) a second error signal $E_2$ at a second output terminal thereof when the magnitude of signal $v_s$ is greater than that of signal $v_i$ by more than tolerance t. A conventional "zero centered meter relay" sold by General Electric is a suitable comparator for the foregoing application.

The appearance of error signal $E_1$ at the first output of comparator 218 indicates that the instantaneous lineal wire velocity $v_i$ is too high and must be reduced in order to attain the selected lay length. Correspondingly, the appearance of error signal $E_2$ at the second output thereof indicates that the instantaneous wire velocity is too low and must be increased. To reduce the wire velocity $v_i$, the reel speed must be increased so that the reel lags the flyer 13 less, while to increase the wire velocity, the reel speed must be reduced so as to increase its lag behind the flyer. The foregoing is accomplished by signals $E_1$ and $E_2$ which, through servo control means 220 (described below), activate the servo motor 63. The latter, in turn, adjusts the position of control shaft 106 ($p_{106}$) of infinitely variable transmission 100, clockwise or counterclockwise by a predetermined number of degrees, thereby causing a corrective adjustment of the reel to flyer ratio K, as described above.

The output terminals of comparator 218 are electrically coupler to servo control means 220, described now with reference to FIG. 7. The first output terminal thereof is coupled to the "set" input of a first latching switch means 222, which may be an electro-mechanical relay or an electronic flip-flop. Similarly, the second output terminal of comparator 218 is coupled to the "set" input of a second latching switch means 224, of the same kind as switch means 222. Switch means 222 and 224 each also have a "reset" input terminal, or its equivalent. Thus, switch means 222 and 224 are adapted to provide a binary output, either (i) a fixed voltage or ground, or (ii) an open circuit ora closed circuit path, depending upon whether an error signal is received on its set terminal or a reset signal is received on its reset terminal. Suitable switch means 222 and 224 may be included in some commercially available zero-centered meter relays which may be used as comparator means 218.

The outputs of switch means 222 and 224 are designated hereafter, and in FIG. 7, as voltages $E_{1'}$ and $E_{2'}$ respectively since the appearance of each requires the prior generation of error signals $E_1$ and $E_2$respectively. It should be understood, however, that $E_{1'}$ and $E_{2'}$ need not necessarily be fixed voltages, but may also be either an open or a closed circuit path, respectively.

The outputs of switch means 222 and 224 are next electrically coupled to corresponding input terminals of a conventional OR gate 226. The OR gate is adapted to pass the error signal $E_{1'}$ or $E_{2'}$ if either of the latter appears on one of its input terminals. The output of OR gate 226 is electrically coupled to a delay circuit means 228, which may be a conventional one-shot multi-vibrator, a delay relay, or their equivalents, all of which are well known to those in the servo control field. The delay circuit means 228 provides an output pulse of a positive, negative, or zero voltage (or, alternatively, an interval of an open or closed circuit path) having a predetermined and selectable period, $P_1$, whenever triggered by the appearance of either signal $E_{1'}$ or $E_{2'}$ at its input terminal. The purpose of delay circuit means 228 is to make the lay length control system 200 "wait" for the period $P_1$, before responding to an indication that the instantaneous lineal wire velocity $V_i$ of the incoming strands 39 is either too fast or too slow with reference to the required velocity $V_s$. In this manner, the control system 200 does not respond to transients or spurious disturbances, and further, it gives the mechanical components of the control loop time to effectuate a corrective adjustment of the parameter K before issuing another control signal, thereby preventing overcorrection. A typical delay period $P_1$ is about three (3) seconds.

The output of delay circuit means 228 is electrically coupled to (i) one input terminal of a conventional AND gate 229; and (ii) to the reset input terminals of both switch means 222 and 224. Switch means 222 and 224 are adapted to be reset at the end of the period $P_1$ so as to be responsive to the subsequent or continuing appearance, if any, of error signals $E_1$ and $E_2$ respectively. The output (signal $E_{1'}$ or $E_{2'}$) of OR gate 226 is electrically coupled to a second input terminal of AND gate 229. AND gate 229 is adapted to provide an output only if both an error signal ($E_{1'}$ or $E_{2'}$) appears concurrently with an enabling output from delay circuit means 228. Delay circuit means 228 is selected so that its output is enabling to the AND gate 229 only in its quiescent state. Thus, in order for AND gate 229 to provide an output, an error signal ($E_1$ or $E_2$) must persist at least an instant beyond the duration $P_1$ of the delay circuit means (at which time the latter's output becomes enabling). By so persisting, the error signal, $E_1$ or $E_2$, again sets the appropriate latching switch means 222 or 224, as the case may be, and corresponding signal $E_{1'}$ or $E_{2'}$ appears at one input of AND gate 229.

The output of AND gate is electrically coupled to a timer circuit means 230. The latter is responsive thereto and adapted to provide, at its output, a voltage pulse V having a selectable period, $P_2$, typically about one (1) second in duration. Voltage pulse V is used to cause the servo motor 63 to be energized only during the period $P_2$, as described below. Suitable timer circuit means will be readily apparent to those having skill in the servo control field.

Servo motor 63 may be a conventional D.C. motor, a 3-phase AC motor or a stepping motor, the particular selection being a matter of design choice for those skilled in the field of electrical machinery. Each motor type is designed for use with a particular control means for causing its output shaft 163 to rotate or step in one direction or the other. In the case of a DC motor, the direction of current flow through the armature winding of the servo motor 63 determines the direction of rotation of its output shaft 163, while in the case of a 3-phase AC motor, the manner in which the voltage phases are interconnected to the motor windings determines such direction of rotation.

With reference to FIG. 7, a functional configuration for a DC type servo motor 63 is shown. Corresponding configurations for AC and stepping type servo motors will be readily apparent to persons skilled in the field. For energizing a DC servo motor 63, a DC power supply 234, having a means 236 for selecting a current amplitude, is electrically coupled to said servo motor 63 through a current polarity control means 238. The error signals $E_{1'}$ and $E_{2'}$ are coupled to two inputs of current polarity control means 238. The latter means is adapted to direct a current from power supply 234 through the armature winding of servo motor 63 either in (i) a first polarity, if error signal $E_{1'}$ appears on one of its inputs, or (ii) the opposite polarity if error signal $E_{2'}$ appears on the other input terminal thereof. Of course, the polarity of the current associated with each of the error signals, $E_{1'}$ and $E_{2'}$, is that polarity which causes the output shaft 163 of servo motor 63 to rotate in a corrective direction. A power switch or gate means 232 is shown is series between the power supply 234 and the winding of DC servo motor 63. The output of timer circuit means 230, i.e., voltage pulse V, is coupled to power switch or gate means 232. Consequently, the current from power supply 234 flows through the armature winding of DC servo motor 63 only during the period $P_2$ of voltage pulse V.

Current polarity control means 238 is often built into the electrical motors 63 with which it is used, or is part of a control unit provided with such motors. If not, however, suitable current polarity control means may be readily implemented using conventional switching circuits and devices known and available in the trade.

It should be understood from the foregoing that both the magnitude and the duration of the pulsed current through the winding of servo motor 63 are selectable, the magnitude by virtue of means 236 in the power supply 234, and the duration by the adjustment of the period $P_2$ of timer circuit means 230. The magnitude of the current pulse governs the rate of rotation of output shaft 163 of the servo motor 63, and thus, the responsiveness of the control system. The period $P_2$ of the current pulse governs the resolution or "fineness" of the lay length correction capability.

The operation of lay length control system 200 is now described briefly, by way of example, with respect to a "too long" lay length, resulting from an instantaneous lineal wire velocity $V_i$ which is too high. The operation with respect to a "too short" lay length condition is, of course, the same except for polarities and the error signal designation.

As discussed above, comparator 218 outputs error signal $E_1$ upon sensing that the istantaneous wire velocity $V_i$ exceeds the required wire velocity $V_s$, by more than the tolerance t (by comparing their electical analogs $v_i$ and $v_s$ respectively). Error signal $E_1$ sets switch means 222, which provides corresponding error signal $E_{1'}$. The latter, via OR gate 226, triggers delay circuit means 228. After a delay of period $P_1$, switch means 222 is reset. Concurrently, after period $P_1$, the output of delay circuit means 228 once again becomes enabling with respect to AND gate 229. If error signal $E_1$ persists beyond period $P_1$, switch means 222 is set again and its output, error signal $E_{1'}$, via OR gate 226 and AND gate 229, triggers timer circuit means 230. The latter outputs pulsed voltage V, having a period $P_2$, to power switch or gate means 232. The closing of power switch or gate means 232 enables current to flow to the armature winding of servo motor 63. By virtue of the appearance of error signal $E_{1'}$ at the input of current polarity control means 238, current from the power supply 238 flows through said armature winding in a corrective direction; that is a direction which causes the output shaft 163 to adjust the position of control shaft 106 ($P_{106}$) of infinitely variable transmission 102. It is recalled from equations (2) and (15) that, $$L=|1-K|\pi D, \quad (2)$$

and $$K - C_1(1-C_2P_{106}). \quad (15)$$

Inasmuch as this description relates to a long lay length condition which is to be corrected, K must be increased. Thus, the position of control shaft 106 must be rotated so that $P_{106}$ decreases, thereby increasing K in accordance with equation (15).

In the event that, notwithstanding the machine's response to the first corrective step of the servo motor 63 pulse, the error signal $E_1$ persists, the above-described cycle is repeated. Consequently, a series of two or more corrective steps, separated by an interval $P_1$, may be required before the selected lay length is re-established.

It should be understood that the particular logic and circuit configuraton described above is only one way in which lay length control system 200 can be implemented. Many variations in this configuration, as well as other configurations, will be apparent to those having skill in the field.

In all of the foregoing description, it has been assumed that the flyer rate of rotation F is substantially a constant. However, this may not be the case; that is, variations in the flyer speed F may arise due to drive belt wear and loss of tension, or other possible causes. In any event, the lay length control system 200 is responsive to variations in the flyer speed F in that its electrical analog, f, (output by generator 206) directly determines the electrical analog $v_s$ of the required wire velocity $v_s$. Thus, a change in $v_s$, due to a change in voltage f, may cause the generation of an error signal, $E_1$ or $E_2$, by comparator 218. This will occur if the change causes voltage $v_s$ to deviate from voltage $v_i$ by more than the tolerance t. Inasmuch as lay length control means 200, in conjunction with variable ratio drive 100, operates to "null" error signals, an adjustment of the reel to flyer ratio K will necessarily follow, causing a corresponding change in the instantaneous wire velocity $v_i$, and, therefore, its analog $v_i$, until $v_i$ equals $v_s$ (within said tolerance). As a consequence, the selected lay length will be maintained, notwithstanding the variation in the flyer speed F.

Viewed operationally, suppose the flyer speed F increases. The parameter K (R/F) will, therefore, decrease and the lay length $L_i$ increase, in accordance with equation (2).

$$L=|1-K|\pi D. \quad (2)$$

By the operation of the control system 200, the reel speed R will be caused to increase, thereby restoring the ratio of reel to flyer speed K to the value required for the selected lay length. Note that, while the reel speed will be caused to increase, so as to maintain the speed ratio K, its increase will be less than that of the flyer 13. As a result, the reel 46 will lag further behind the flyer 13, causing an increase in the velocity of the wire 41 being drawn into the machine. However, inasmuch as the period of each flyer revolution is correspondingly less, the desired lay length is maintained.

Figure 8:
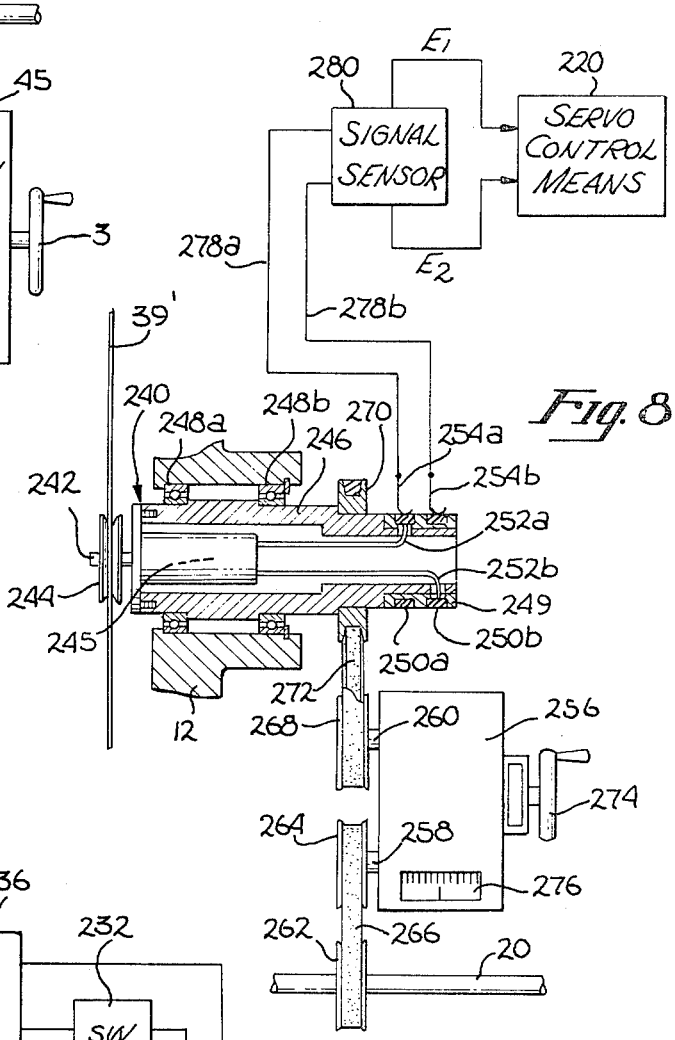
FIG. 8 is a side elevation view of a second, i.e., an electro-mechanical, embodiment of means for generating a lay length error signal within the lay length control system.

With reference to FIG. 8, a second embodiment of the error sensing and generating portion of lay length control system 200 is now described. In this second embodiment only one electrical D. C. generator 240 is used. It is one of the type which generate an output voltage whose polarity is a function of the direction of rotation of its input shaft 242 with respect to the generator housing 245.

The generator's housing 245 is concentrically mounted within a hollow shaft 246, which is rotatably supported by bearings **248*a* and 248*b* mounted on fram 12 of the apparatus 10. The generator housing 245 is adapted to rotate in the same direction as does the generator shaft 242**.

A pully 244 is mounted to the shaft 242. An individual wire strand 39' is wrapped around, or otherwise contacts and drives, the pulley 244, thereby driving the input shaft 242.

The rear portion of hollow shaft 246 has mounted on it an insulating sleeve 249. Two slip rings, 250*a* and 250*b*, are mounted on the sleeve 249. The output wires of generator 240, namely wires 252*a* and 252*b*, are electrically coupled to slip rings 250*a* and 250*b* respectively. Brushes 254*a* and 254*b* engage the slip rings 250*a* and 252*b* respectively.

The main input shaft 20 of the apparatus 10 is mechanically coupled to the hollow shaft 246 by means of (i) a variable ratio transmission 256 having an input shaft 258 and an output shaft 260; (ii) pulley 262 mounted on input shaft 20; (iii) pulley 264 mounted on transmission input shaft 258; (iv) positive drive belt 266 interconnecting pulleys 262 and 264; (v) pulley 268 on transmission output shaft 260; (vi) pulley 270 mounted on hollow shaft 246; and positive drive belt 272 interconnecting pulleys 268 and 270.

The variable ratio transmission 256 is equipped with manual means 274 for varying its internal ratio (shown symbolically as a handwheel in FIG. 8), and a ratio indicator 276, calibrated to read directly in units of lay length (inches or centimeters). Thus, the manual means 274 and indicator 276 enable the selection of any lay length within the operating range of the invented machine (which range will vary as a function of the particular embodiment thereof.) A suitable variable ratio transmission for the foregoing purpose is available from the Winsmith Company.

Lastly, wires 278*a* and 278*b* electrically couple the brushes 254*a* and 254*b* to the first and second inputs of a signal sensor 280 respectively. Signal sensor 280 is adapted to produce an error signal at either of two outputs thereof whenever the magnitude of the voltage generated, $v_g$, appearing between wires 278*a* and 278*b*, exceeds the tolerance t. Error signal $E_1$ appears at a first output of signal sensor 280 when the polarity of the generated voltage $v_g$ is that caused by too high a wire velocity $V_i$, while error signal $E_2$ appears at a secnd output when the polarity of $v_g$ is that caused by too low a wire velocity. Signal sensor 280 may be implemented by a conventional "zero-centered meter relay". Such a zero-centered meter relay could also include the switch means 222 and 224 described above as part of servo control means 220.

The operation of the foregoing generator 240 configuration is now described. It should be clear that if the generator's input shaft 242 rotates at the same rate as its housing 245, no voltage $v_g$ will be generated. Thus, $$V_g = c_8(r_{242} - r_{245}), \tag{20}$$

where $r_{242}$ is the rotational rate of the input shaft 242 (rpm); $r_{245}$ is the rotational rate of the housing 245 (rpm); and $c_8$ is an eighth constant.

Inasmuch as the wire 39' drives the shaft 242, the rotational rate of shaft 242, $r_{242}$, is proportional to the instantaneous lineal wire velocity Vi. Thus, $$r_{242} = c_9\ Vii, \tag{21}$$

where $c_9$ is a ninth constant.

Inasmuch as input shaft 20 drives the generator housing 245, via variable transmission 256, the rotational rate of the housing $r_{245}$ is proportional to the rate of rotation of shaft 20 and a variable function of the position of manual lay length selection means 274 ($p_{274}$). Thus, $$r_{245} = c_{10} r_{20} p_{274}, \tag{22}$$

where $c_{10}$ is a tenth constant.

From equation (7) above, $r_{20} = F/c_3$. Thus, $$r_{245} = (c_{10}/c_3)\ F\ p_{274}. \tag{23}$$

Substituting the values of $r_{242}$ and $r_{245}$ from equations (21) and (23) respectively into equation (20), $v_g$ is obtained as follows:

$$v_g = c_8(c_9 V_i - \frac{c_{10}}{c_3} F\ P_{274}). \tag{24}$$

From equation (16), $V_i - L_i F$. Thus $$v_g = c_8(C_9 L_i F - \frac{c_{10}}{c_3} F\ P_{274}). \tag{25}$$

$$v_g = C_3 F L_i - C_4 F p_{274}, \tag{26}$$

where $C_3 = c_8 c_9$ and $C_4 = c_8 c_{10}/c_3$.

The position of calibrated lay length selection means 274 is proportional to the selected lay length $L_s$. Thus, $$P_{274} = C_5 L_s, \tag{27}$$

where $C_5$ is a constant.

Substituting the value of $P_{274}$ from equation (27) into equation (26), $v_g$ is obtained as follows:

$$v_g = C_3 F L_i - C_4 F C_5 L_s, \tag{28}$$

or $$v_g = C_3 F(L_i - C_6 L_s), \tag{29}$$

where $C_6 = C_4 C_5 / C_3$.

In order that the generator 240 generate no output voltage when $L_i = L_s$, the calibration of the selection means 274 and its indicator 276 must be such that $C_6 = 1$. Thus, $$v_g = C_3 F(L_i - L_s). \tag{30}$$

In view of the foregoing equation (30), it is evident that if the instantaneous lay length $L_i$ increases with respect to that selected, $L_s$, a voltage $v_g$, of positive polarity, appears between output wires 278*a* and 278*b*, causing signal sensor 280 to provide error signal $E_1$ at its first output terminal. Conversely, if the instantaneous lay length $L_i$ decreases with respect to that selected, $L_s$, a voltage $v_g$ of the opposite polarity appears on said output wires, causing signal sensor 280 to provide an error signal $E_2$ at its second output terminal. As seen from equation (30), the magnitude of $v_g$ depends upon the magnitude of the lay length error, while the polarity of $v_g$ depends on whether the shaft 242 runs clockwise or counterclockwise relative to the housing 245 when a lay length error appears. The error signal $E_1$ or $E_2$ is fed into servo control means 220, the structure and operation of which has already been described above.

The operation of generator 240 in controlling the lay length is further described with reference to the following example: Suppose that (i) the circumference of pulley 244 is 10 inches; (ii) the main input shaft 20 makes one revolution for each revolution of the flyer 13; (iii) the ratio of variable ratio transmission 256 is 1:5 reduction; (iv) the ratio of pulleys 262 and 264 is 1:1; (v) the ratio of pulleys 268 and 270 is also 1:1; and (vi) the selected lay length is 2 inches. To achieve the selected lay length, 2 inches of wire strand 39' have to travel over pulley 244 and into the machine for each revolution of flyer 13. Since the circumference of pulley 244 is 10 inches, the two inch movement of the wire will produce a pulley rotation of 2/10 or one-fifth (1/5) revolution. If the flyer speed F is 1000 rpm, pulley 244 will have to rotate at $1/5 \times 1000$ or 200 rpm, (i.e., be driven at that rate by the wire strand 39') in order to achieve the selected lay length. By virtue of the 1:5 reduction ratio of variable ratio transmission 256, the generator housing 245 is driven at one-fifth the speed of the flyer 13, or 200 rpm. Thus, it is seen that, because both the generator housing 245 and its input shaft 242 are rotating at the same rates, i.e., 200 rpm, there is no relative motion between them. Consequently, no voltage $v_g$ appears. In the event that 2.1 inches of wire starts to be drawn into the machine during each flyer revolution (resulting in a lay length of 2.1 inches), the pulley 244 would be driven at 210 rpm, while the housing 245 would still rotate at 200 rpm. The relative speed of the shaft 242 with respect to the housing 245 would then be 10 rpm, causing a voltage $v_g$ greater than tolerance t to appear between wires **278*a* and 278*b*. The voltage $v_g$ would be positive at the input to signal sensor 280. Thus, the latter would output an error signal $E_1$, indicating a "too fast" lineal wire velocity, or a "too long" lay. This lay error would then be corrected by the remainder of the control system 200 and variable ratio drive 100, as described above, so as to increase the rate of rotation of reel shaft 36**, and thereby, return the lay length back to 2 inches.

WIRE LAYERING CONTROL SYSTEM

Figure 9:
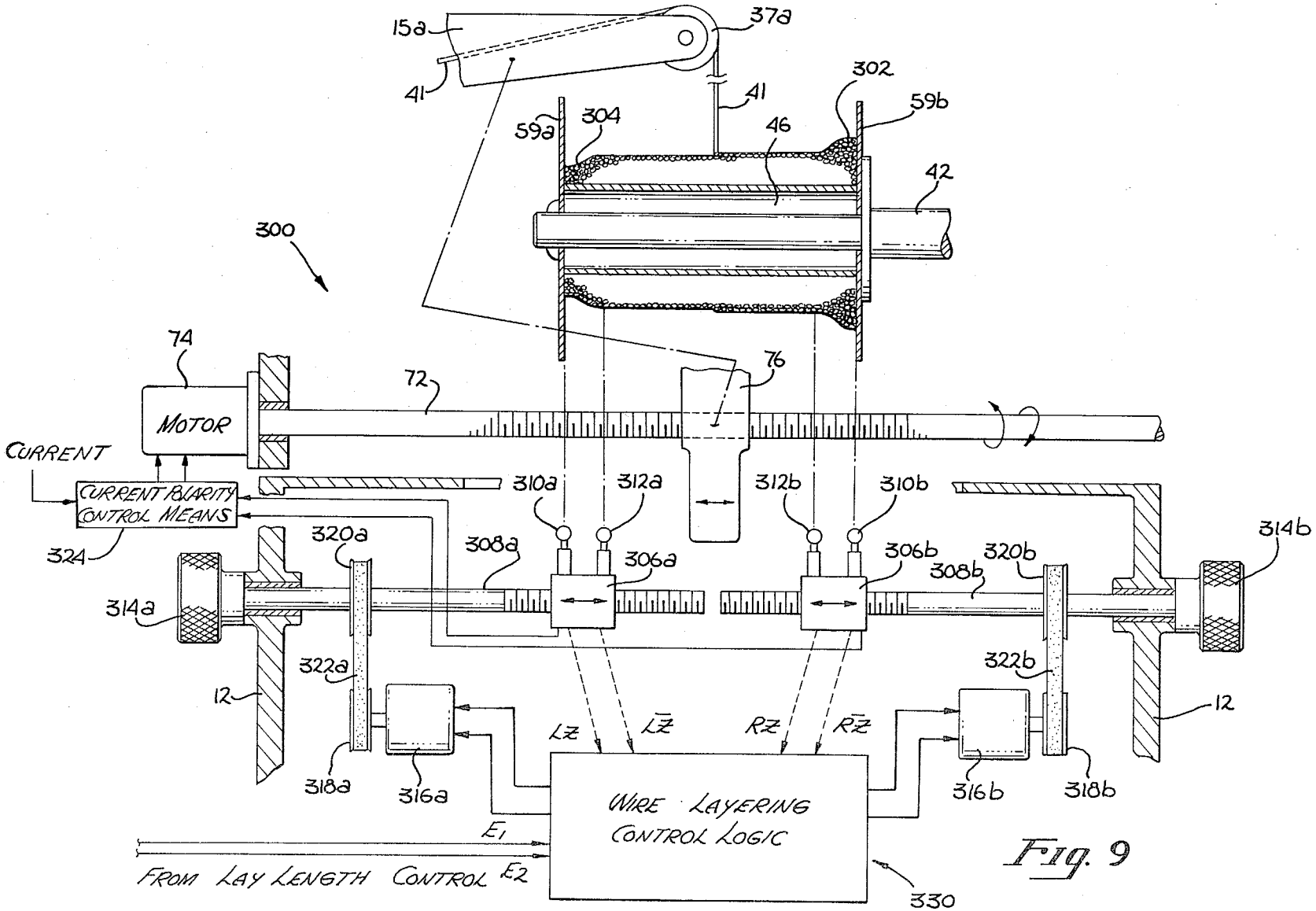
FIG. 9 is a side elevation view of the automatic wire layering control system portion of the present invention.
Figures 9, 10:
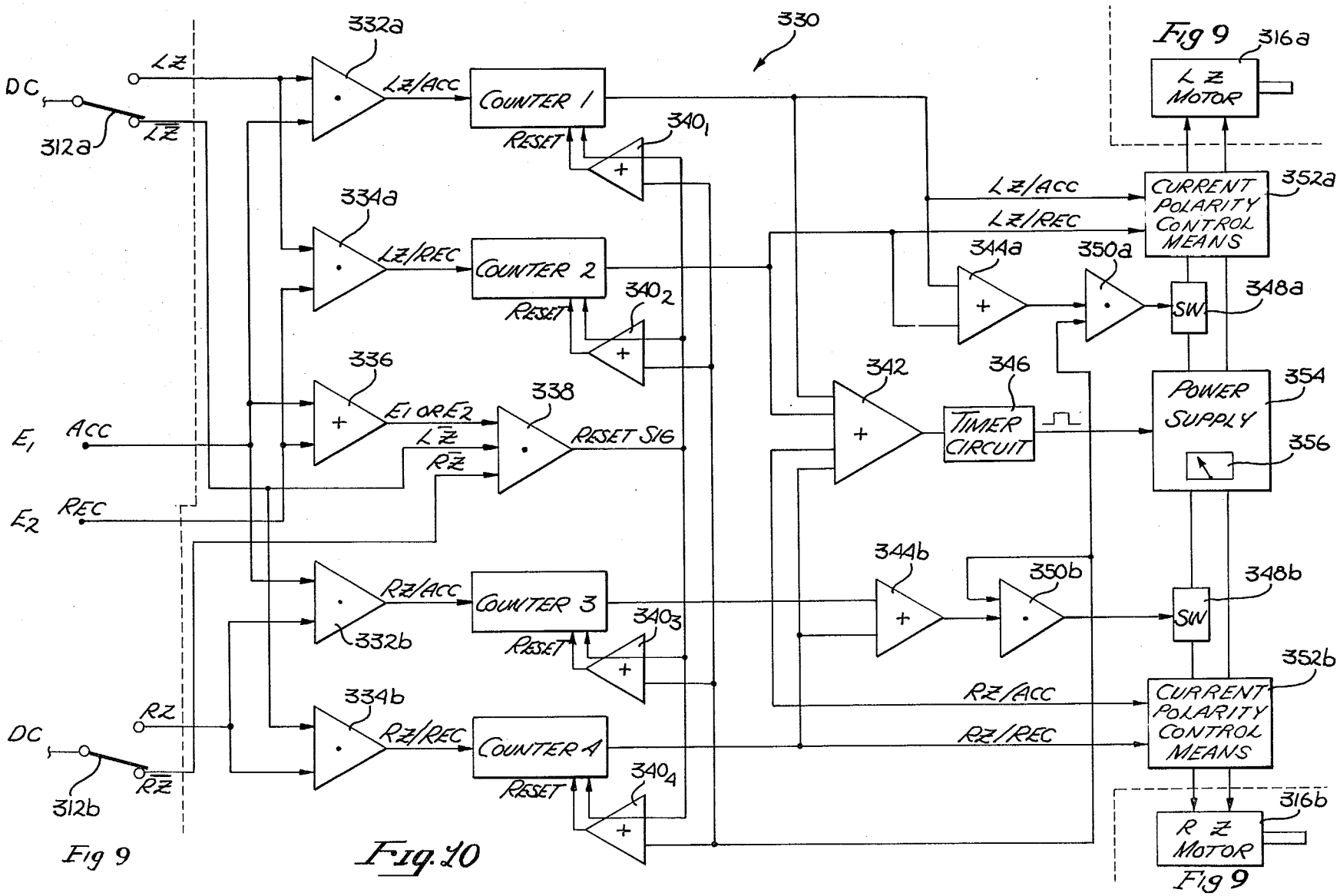
FIG. 10 is a block diagram representation of the logic means portion of the wire layering control system.

With reference to FIGS. 9 and 10, attention is now directed to the wire layering control system 300 which is part of the present invention. It is recalled that when bunched and twisted wire 41 leaves the arm pulley **37*a* (or 37*b*) of flyer 13, it is both wound onto reel 46 and, at the same time, axially transversed back and forth across the internal width of the reel. It is desirable to have wire 41 build up on the reel 46 in uniform cylindrical layers, each layer having equal diameter across the entire reel. Typically, it is not a problem to achieve even layers of wire when the flyer arm pulley 37 is not in the vicinity of the reel flanges 59*a* or 59*b*. However, in the vicinity of the flanges, the timing and point of reversal of the flyer carriage 68 are critical to the achievement of even layers of wire. If reversal occurs too late or too close to a flange 59, an excess of wire 41 will pile up against the flange; see, for example, the hill-like accumulation 302 shown against flange 59*b* in FIG. 9. Conversely, if the flyer carriage reversal occurs too early or too far from the flange 59, a deficiency of wire 41 will develop between the flange and the point at which the carriage 68 reverses; see, for example, the resulting valley or recess 304 in the vicinity of reel flange 59*a***.

When an accumulation 302 of wire 41 develops against a reel flange 59, the instantaneous effective diameter of the reel 46 increases rapidly. This causes the instantaneous lineal wire velocity $V_i$ to increase. In the present invention, such an increase in wire velocity will be sensed by the automatic lay length control system 200, which will generate the error signal $E_1$, as above-described. Correspondingly, when a recess 304 of wire 41 develops near a flange 59, the instantaneous effective diameter of the reel 46 decreases as wire is wound in the recess. Under these circumstances, the lay length control system 200 will sense a decrease in the instantaneous lineal wire velocity $V_i$ and generate an error signal $E_2$. Thus, it is apparent that error signal E ($E_1$ or $E_2$) may indicate an error in the timing and point of reversal of flyer carriage 68, as well as a lay length error due to normal wire build-up on the reel (or any other cause). Therefore, in order to utilize error signal E for correcting errors in the timing and point of reversal of the flyer carriage 68, it is necessary to be able to distinguish an error signal caused thereby from one caused by a lay error. The wire layering control system 300 of this invention provides means for so recognizing reversal point errors from others, as well as means for responding thereto so as to correct the erroneous reversal of the flyer carriage 68. In the following description, it will be assumed that the reversal of the flyer carriage 68 is instantaneous, and that, if done at the correct point and time, even layers of wire 41 will be achieved. While, in reality, this ideal is not realizable, the wire layers attainable by this invention are nevertheless substantially uniform, and more so than heretofore has been possible.

A left nut block **306*a* is threadably located on an adjustment screw 308*a* rotatably mounted in main frame 12, while a right nut block 306*b* is correspondingly threadably located on an adjustment screw 308*b*, also rotatably mounted in frame 12. Mounted on left nut block 306*a* is (i) a left reversal means 310*a* and (ii) a left zone sense means 312*a*. Similarly, a right reversal means 310*b* and right zone sense means 312*b* are mounted on right nut block 306*b*. The distance between each reversal means 310 and its associated zone sense means 312 is selected to define the width of left and right "zones", a zone being the region near each reel flange 59 in which wire accumulations and recesses may occur. The positions of the nut blocks 306, and, therefore, of the reversal means and zone sense means 310 and 312 respectively, are determined by the angular rotation of adjustment screws 308. The adjustment screws 308 are rotated either manually by adjustment knobs 314*a* (left) and 314*b* (right), or by drive means 316*a* (left) and 316*b* (right). Drive means 316 is coupled to each adjustment screw 308 by means of a pulley 318 mounted on its output drive shaft, a pulley 320 mounted on adjustment screw 308 and drive belt 322 interconnecting pulleys 318 and 320. Conventional electrical limit switches are suitable for implementing reversal means 310 and zone sense means 312. Suitable for drive means 316** is an electric motor, of the DC, AC, or stepping type.

As described above in connection with twisting and winding apparatus 10, flyer carriage 68 is driven by screw drive means 74 rotating reversing screw 72, first in one direction and then in the reverse direction. Electrical current from a source (not shown) is coupled to drive means 74 through current polarity control means 324. Current polarity control means 324 has two inputs, one electrically coupled to left reversal means **310*a* and the second to right reversal means 310*b*. Current polarity control means 324, comprising conventional switching circuits known in the trade, is adapted to direct current from the power source to the winding of drive means 74 in (i) of first polarity when left reversal means 310*a* is activated by the threaded member 76 of flyer carriage 68 engaging it; and (ii) the opposite polarity when right reversal means 310***b* is activated by said threaded member 76 engaging it. Thus, it is apparent that the reversal of the direction of rotation of screw 72, and therefore, the reversal of flyer carriage 68, depends upon the location of nut blocks 306*a* and 306*b* on adjustment screws 308*a* and 308*b* respectively.

There is one position of each nut block 306 on each adjustment screw 308 which so locates the corresponding reversal means 310 that threaded member 76 engages (or otherwise activates) each reversal means 310 at the time wire 41, coming off flyer arm pulley 37*a*, has just reached reel flange 59. When nut blocks 306 are so located, the resulting reciprocal action of flyer carriage 68, i.e., the timing and points of its reversal, will be such that neither a wire accumulation 302 nor a wire recess or valley 304 will develop. As a consequence, the layers of wire 41 wound on reel 46 will be substantially uniform.

The automatic location of the foregoing ideal positions of nut blocks 306*a* and 306*b*, by the appropriate activation of drive means 316*a* and 316*b* respectively, is accomplished by wire layering control logic 330 which forms a part of the control system 300. With reference to FIG. 10, this logic 330 is now described in detail.

For purposes of explanation, the left and right zone sense means 312*a* and 312*b* are shown symbolically as simple binary switches which provide a D.C. voltage on either of two output terminals. When the zone sense means 312 is engaged (and switched) by threaded member 76, while the carriage is traversing in a direction away from the center (i.e., toward the reversal means 310), the D.C. voltage appears on the switch output which is designated to indicate that the wire 41 is entering into one or the other of the zones. Correspondingly, when the threaded member 76, traversing toward the center (i.e., away from the reversal means 310), engages (and switches) the zone sense means 312, the D. C. voltage then appears on the second output of sense means 312, the one designated to indicate that the wire 41 is now leaving one or the other zone. Thus, with reference to left zone sense means 312*a*, it outputs to wire layering control logic 330 either (i) a signal LZ indicating that the wire 41 is in the left zone of the reel, or (ii) a signal $\overline{LZ}$ indicating that the wire 41 is outside of the left zone. Similarly, right zone sense means 312*b* provides either a RZ signal (in the right zone) or an $\overline{RZ}$ signal (outside of the right zone). Also being input to the control logic 330 are error signals $E_1$ and $E_2$ indicating a possible wire accumulation 302 or wire recess 304 respectively. These error signals are electrically coupled to the control logic 330 from the output of comparator means 218 of the lay length control system 200. Of course, these error signals could be generated independently of the control system 200 in the same manner as that described with respect to the control system.

For purposes of distinguishing error signals $E_1$ and $E_2$ caused by reversal point errors from those caused by lay errors, two conventional AND gates are provided with respect to each zone. The AND gate 332*a* is provided having two input terminals electrically coupled to the lines which carry signals LZ and $E_1$, while AND gate 334*a* is provided having two input terminals electrically coupled to the lines which carry signals LZ and $E_2$. AND gate 332*a* is adopted to provide a binary output if and only if both signals LZ and $E_1$ appear on its input terminals concurrently; that is, if and only if wire accumulation is sensed when wire 41 is being wound in the left zone. Correspondingly, AND gate 334*a* is adapted to provide a binary output if and only if a wire recess is sensed when wire 41 is being wound in the left zone.

AND gates 332*b* and 334*b* are provided for the same purpose as AND gates 332*a* and 334*a* respectively and are interconnected in the same manner just described with respect to the latter AND gates, except that it is the outputs RZ and $\overline{RZ}$ of right zone sense means 312*b* which are electrically coupled to the corresponding input terminals of AND gates 332*b* and 334*b*. The foregoing AND gates may be implemented with electronic integrated circuits or by electro-mechanical relay logic, all well known and available to the trade.

The outputs of AND gates 332*a*, 334*a*, 332*b*, and 334*b* are electrically coupled to the input terminals of conventional binary counters 1, 2, 3, and 4 respectively. The counters also each have a separate reset terminal. If the counters are implemented by means of relays, separate count and reset coils are provided for each. The counters 1, 2, 3, and 4 count possible occurrences of the following events:

Counter 1: Accumulations in the left zone
Counter 2: Recesses in the left zone
Counter 3: Accumulations in the right zone
Counter 4: Recesses in the right zone The foregoing counters enable the wire layering control system 300 to distinguish wire accumulations 302 and recesses 304 from lay errors. This is done by providing means for resetting all of the counters if an indication of a too fast or a too slow lineal wire velocity (i.e., signal $E_1$ or $E_2$) persists when the wire 41 is being wound outside of either the left or right zones (hereinafter referred to as the "center zone").

The means for resetting the counters comprises (i) a conventional OR gate 336 having two input terminals electrically coupled to the lines carrying the error signals $E_1$ and $E_2$ respectively, and an output terminal on which OR gate 336 is adapted to provide a binary output if either error signal $E_1$ or $E_2$ appears on one of its input terminals; and (ii) a conventional AND gate 338 having three input terminals electrically coupled to the output of OR gate 336 and to the lines carrying the $\overline{LZ}$ and $\overline{RZ}$ signals from zone limit switches 312*a* and 312*b* respectively. AND gate 338 is adapted to provide a binary output if and only if either error signal $E_1$ or $E_2$ appears at one of its three input terminals concurrently with the appearance of the $\overline{LZ}$ and the $\overline{RZ}$ signals on the other two input terminals; in other words, only if a too fast or too slow wire velocity is sensed when the wire 41 is being wound in the center zone, thereby indicating a lay length error and not a wire accumulation or recess. The output of AND gate 338, designated the "reset signal" is electrically coupled to the reset terminal of each of the counters 1, 2, 3, and 4 through conventional OR gates $340_1$–$340_4$ respectively. Thus, following the appearance of an error signal E when wire 41 is being wound in either the left or right zone, indicating a possible wire accumulation or recess, (and a corresponding "count" by the appropriate counter), the foregoing reset logic will reset all the counters if the error signal persists to the time when wire is being wound in the center zone. This is the desired result because the existence of the error signal E when wire 41 is being wound in the center zone indicates that the wire velocity error which caused the generation of the error signal can not be attributed to a wire accumulation or recess in the vicinity of the reel flange 59. The reset logic, comprising OR gate 336 and AND gate 338, can be implemented using conventional electronic integrated logic circuits or by way of electromechanical relay logic.

It should be understood from the above discussion that at least two occurrences of a possible wire accumulation or recess, but preferably more than two, is required before such a wire accumulation or recess is verified and corrective action taken. Thus, the counters are selected or arranged to have a predetermined number or count which must be reached before they provide a binary output (or over-flow) indicating that the condition to which they are each responsive is verified. For example, when the predetermined number is reached in counter 2, a recess condition in the right zone will be verified. Of course, such predetermined number will not be reached if the counter is reset as a result of the discriminating function of the reset logic.

Assuming one of the counters has reached its predetermined number, the control system 300 must respond to this indication of a wire accumulation or recess. The means provided in the wire layering control logic 330 for responding are now described. Each of the outputs of the four counters are electrically coupled to four corresponding input terminals of an OR gate 342 adapted to provide a binary output if an output from any one of the counter (upon reaching its predetermined number) appears on any one of the OR gate's input terminals. The appearance of a binary output from OR gate 342, therefore, indicates that a corrective action is to be taken.

Another OR gate **344*a* has coupled to its input terminals the outputs from counter 1 and counter 2. OR gate 344 is adapted to provide a binary output if a binary output from either of said counters (1 or 2) appears on one of its two input terminals. The appearance of a binary output from OR gate 344*a* indicates that the corrective action which is to be taken is to be an adjustment of the position of the left nut block 306*a* and, therefore, of the position of the left reversal means 310*a***.

An OR gate **344*b*, corresponding in function and operation to that of OR gate 344*a*, has its two input terminals electrically coupled to the outputs of counters 3 and 4. Thus, the appearance of a binary output from OR gate 334*b* indicates that the corrective action which is to be taken is to be an adjustment of the position of the right nut block 306*b* and, therefore, of the position of the right reversal limit switch 310*b***.

The output of OR gate 342 is electrically coupled to a conventional timer circuit means 346 similar to the timer means 230 used in servo control means 220. The timer circuit means 346 is adapted to output a voltage pulse having a selectable period $P_3$, typically about one (1) second in duration. The voltage pulse output by timer circuit means 346 is used to cause the left zone and right zone drive means 316 to be energized only during the period $P_3$, as described below. Suitable timer circuit means will be readily apparent to those having skill in the field.

Enabling AND gates **350*a* and 350*b* are provided to direct the voltage pulse output by timer circuit means 346 to either a left drive power switch or gate 348*a* or a right drive power switch or gate 348*b*. Drive power switches (or gates) 348*a* and 348*b* are shown coupled in series between the power supply 354 and the corresponding zonal drive means 316*a* and 316*b*, respectively. Enabling AND gate 350*a* has two input terminals, one electrically coupled to the output of timer circuit means 346 and the other to the output of OR gate 344*a*. Similarly, enabling AND gate 350*b* has two input terminals coupled to the outputs of timer circuit means 346 and OR gate 344*b*. If OR gate 344*a* provides a binary output, indicating that adjustment of the left zone nut block 306*a* is required (because either an accumulation or a recess has been sensed), the enabling AND gate 350*a* will pass the voltage pulse output by the timer means 346. This is because binary voltages will appear concurrently on the two input terminals of the AND gate 350*a*, which satisfies the condition for such gate to provide a binary output. The output of AND gate 350*a* is electrically coupled to left drive power switch or gate 348*a*, which is adapted to close or otherwise allow current to flow to the winding of left zone drive means 316*a*, for the period $P_3$, in response to voltage pulse passed by AND gate 350*a*. Power supply 354 is electrically coupled to the winding of left zone drive means 316*a* through left drive current polarity control means 352*a*. Left drive current polarity control means 352*a* directs electric current to the winding of left drive means 316*a* (during period $P_3$) in a current direction suitable for making the required adjustment of the position of nut block 306*a***.

Similarly, if OR gate **344*b* provides a binary output, indicating that adjustment of the right zone nut block 306*b* is required, the enabling AND gate 350*b* will pass the voltage pulse output by the times means 346. The output and AND gate 350*b* is electrically coupled to right drive power switch or gate 348*b*, which is adapted to close or otherwise allow current to flow to the winding of right zone drive means 316*b*, for the period $P_3$, in response to the voltage pulse passed by AND gate 350*b*. Power supply 354 is electrically coupled to the winding of right zone drive means 316*b* through a right drive current polarity control means 352*b*. The latter, in turn, directs the electric current from the power supply 354 to the winding of right drive means 316*b* (for the period $P_3$) in a direction suitable for making the required adjustment of the position of right zone block 306*b***.

Left drive current polarity control means **352*a* has electrically coupled to it the outputs of counters 1 and 2; that is, the signals indicating a left zone accumulation and a left zone recess respectively. Similarly, right drive current polarity control means 352*b* has coupled to it the outputs of counters 3 and 4; that is, the signals indicating a right zone accumulation and a right zone recess respectively. The drive current polarity control means 352 are each adapted to pass, for the period $P_3$, a current from power supply 354 to the drive motor 316 having either (i) a first polarity, if the output of one counter appears on one of its inputs, or (ii) the opposite polarity, if the output of the second counter appears on the other of its input terminals. The polarity of the current passed is, of course, that polarity which causes the drive means 316 to rotate adjustment screw 308 in that direction which will cause the nut block 306** to move in a corrective direction.

Current polarity control means 324, **352*a* and 352*b*** are often built into the electrical motors with which they are associated or are part of a control unit provided with such motors. If not, however, suitable current polarity control means may be readily implemented using conventional switching curcuits and devices known and available in the trade.

It should be understood that both the magnitude and the duration of the drive current pulse to drive means 316 are selectable, the magnitude by virtue of amplifying means 356 in the power supply 354, and the duration by the adjustment of the period $P_3$ of timer circuit means 346. The magnitude of the drive current governs the rate of rotation of adjustment screw 308, and thus, the responsiveness of the control system. The period $P_3$ of the drive current pulse governs the resolution or "fineness" of the reversal limit switch adjustment capability.

The output of timer circuit means 346 is also electrically coupled to the reset terminal of each of the counters 1–4. Thus, after an adjustment is made of one of the nut blocks 306, for the period $P_3$, the counters are reset and the systems 300 must again detect and verify that the need for an adjustment still exists before a subsequent adjustment is made. Consequently, a series of two or more corrective adjustments, separated by the time required for verification (typically, 2 cycles of the flyer carriage traverse), may be required before the position of the nut block 306 involved is correct for even wire layers.

It should be understood that the particular logic and component configuration described above is only one way in which wire layering control system 300 can be implemented. Many variations in this configuration, as well as other logic configurations, will be apparent to those having skill in the field. For example, it is not mandatory, although preferable, to verify that a possible wire accumulation or recess is occurring by counting such occurrences. Instead, a special relay may be used in lieu of a counter (equivalent to setting the predetermined number to one. Moreover, timer circuit means 346 need not be used, so that, instead of a series of incremental adjustments, adjustment will be continuous for so long as a recess or accumulation condition is detected.

A further variation is the use of time delay relays instead of limit switches for the left zone and right zone sense means 312*a* and 312*b* respectively. In such a configuration, the actuation of the left and right reversal means 310*a* and 310*b* each actuate corresponding time delay relays after each reversal of the flyer carriage 68. The time delay relays provide a time interval (e.g., a circuit path closure), which interval defines the period during which wire 41 is being wound in one or the other end zones. After the period of the time delay relays passes, the wire 41 is, by definition, being wound in the center zone, and the persistence of an error signal E is then checked. If present, the counters are reset (because the error signal would then be due to lay error and not a wire accumulation or recess. The foregoing variation has the advantage of requiring fewer components to be mounted on the machine. The avoidance of having to install two zone limit switches 312 is particularly advantageous when retrofitting an existing machine having a conventional, non-automatic means for controlling the reversal of flyer carraige 68.

The operation of wire layering control system 300 is now described briefly, by way of example, with respect to a wire recess in the left zone. The operation with respect to a wire accumulation in either zone or a recess in the right zone is the same, except with respect to the particular logic paths and polarities involved.

When the threaded number 76 engages left zone sense means 312*a*, AND gates 332*a* and 334*a* are enabled. Inasmuch as a wire recess causes a decrease in lineal wire velocity, lay length control system 200 generates and outputs error signal $E_2$. Error signal $E_2$ will cause AND gate 334*a* to provide a binary output to counter 2. If this occurs the predetermined number of times, counter 2 will provide a binary output, through OR gate 342, to trigger timer circuit means 346. At the same time, the output from counter 2 will, via OR gate 344*a*, be input to enabling AND gate 350*a*. The latter, in turn, will pass the pulsed voltage output by timer circuit means 346, causing left drive power switch 348*a* to switch "on". As a result, electrical current from power supply 354 will be coupled to left drive current polarity control means 352*a*. By virtue of the appearance of a binary output from counter 2, indicating a left zone wire recess, left drive current polarity control means 352*a* will cause the electrical current from power supply 354 to flow to the winding of left zone drive means 316*a* with that polarity which makes the latter rotate adjustment screw 308*a* in that direction which causes the left nut block 306*a* to step away from the center. Thus, in this manner, by one or more adjustments, the position of the left reversal means 310*a* will be automatically set to eliminate the wire recess in the left zone.

While the drawings show the significant structural features of this invention, the particular proportions and geometric forms of actual mechanical components thereof may be different. Moreover, while the present invention has been disclosed and described with reference to particular embodiments, the principles involved are susceptible of other applications which will be apparent to persons skilled in the art. This invention, therefore, is not intended to be limited to the particular embodiments herein disclosed.

I claim:

1. A wire twisting and winding apparatus comprising:

(a) a frame;

(b) input and reel shafts rotatably mounted on said frame, said shafts being inter-coupled by a variable ratio drive means;

(c) means for driving said input shaft coupled thereto;

(d) a flyer rotatably mounted on a flyer carriage and drivably coupled to said input shaft, said flyer carriage being reciprocally mounted on said frame;

(e) means for reciprocally driving said flyer carriage;

(f) a pivot frame pivotally mounted on said frame;

(g) a reel spindle rotatably mounted on said pivot frame, said reel spindle being drivably coupled to said reel shaft and adapted to removably receive a take-up reel and to rotate said reel relative to said flyer;

(h) means for bunching and guiding a plurality of wire strands to said flyer, said bunching means being mounted on said frame, and said flyer being adapted to direct said bunched wire onto said take-up reel for winding; and (i) control means coupled to said variable ratio drive means for adjusting the ratio thereof during the the winding of said bunched wire onto said reel so as to vary the rate of rotation of said reel shaft relative to that of said input shaft by an amount corresponding to the build-up of said wire on said reel, whereby, said bunched wire is given a single twist for each rotation of said flyer, and said wire is wound onto said reel in distributed layers between left and right flanges thereof.

2. The apparatus of claim 1 wherein said reel spindle is disposed coaxially with said flyer.

3. The apparatus of claim 1 whereby said pivot frame is adapted and configured to rotate approximately 90° between a first substantially horizontal position and a second substantially vertical position, whereby said take-up reel is loaded onto and unloaded from said reel spindle when said pivot frame is in said first position, and in an operational mode when said pivot frame is in said second position.

4. The apparatus of claim 3 wherein said means for coupling said reel spindle to said reel shaft comprise a reel jack-shaft rotatably mounted on said pivot frame and disposed coaxially with the axis of said pivot frame, first means for drivably coupling said reel shaft to said reel jack-shaft and second means for drivably coupling said reel jack-shaft to said reel spindle, whereby said pivot frame may be rotated between said first and second positions thereof without displacement of said first and second coupling means.

5. The apparatus of claim 1 wherein said flyer is drivably coupled to said input shaft by means comprising:

(i) a spline jack-shaft having a hollow coaxial interior rotatably mounted on said flyer carriage and drivably coupled to said flyer;

(ii) a spline nut coaxially disposed within said hollow interior of said spline jack-shaft and adapted to transmit torque thereto; and (iii) a spline shaft rotatably mounted to said frame and disposed coaxially within said hollow interior of said spline jack-shaft in slidable engagement with said spline nut, said spline shaft being drivably coupled to said input shaft.

6. The apparatus of claim 1 wherein said bunching and guiding means comprises:

(i) a die shaft having a coaxially hollow interior rotatably mounted on said frame and disposed coaxially with said flyer, said die shaft being drivably coupled to said input shaft; and (ii) a closing die disposed coaxially within said hollow interior of said die shaft in torque-transmitting engagement therewith, said closing die having a coaxial opening thereon and a profile adapted to impart a twist to a bunched plurality of wire strands passing therethrough.

7. The apparatus of claim 6 wherein said bunching and guiding means further comprises a spider plate mounted on said frame, said plate having a plurality of openings therein adapted to pass and bunch said corresponding plurality of wire strands.

8. The apparatus of claim 6 wherein said die shaft is drivably coupled to said input shaft through a variable ratio transmission having means for selecting said ratio, whereby, said ratio is selected to cause a temporary overtwist of said bunched wire strands in order to overcome a problem of wire spring back.

9. The apparatus of claim 6 wherein said flyer has a coaxially hollow interior and said bunching and guiding means further comprises a forming die disposed coaxially within said hollow interior of said flyer in torque-transmitting engagement therewith, said forming die having a coaxial opening therein and a profile adaptable to further compacting said bunched wire strands.

10. The apparatus of claim 1 wherein said flyer carriage drive means comprises:

(i) means for converting rotational motion to translational motion;

(ii) motor means coupled to said flyer carriage through said motion converting means;

(iii) left and right reversal means movably mounted on said frame in spatial relation to said flyer carriage and coupled to said motor means, said reversal means being adapted to cause a reversal of the drive direction of said motor means when activated; and (iv) means affixed to said flyer carriage for activating said left and right reversal means alternately as said flyer carriage traverses reciprocally, whereby, the positions of said left and right reversal means are selected to cause said flyer carriage to reverse direction when said bunched wire being wound onto said reel reaches said left and right flanges thereof respectively, so that said wire is wound thereon in substantially uniform cylindrical layers.

11. The apparatus of claim 10 having in addition thereto, second control means for automatically adjusting the positions of said left and right reversal means comprising:

(i) left and right drive means coupled to said left and right reversal means respectively for moving the same relative to said flyer carriage;

(ii) left and right zone sense means mounted on said frame in spatial relation to said left and right reversal means respectively and said flyer carriage, said zone sense means being adapted to provide, when activated by said activating means, an indication that said flyer carriage is within predetermined left and right zones with respect to said left and right reversal means respectively;

(iii) first means coupled to a strand of said wire being drawn into said apparatus, said first means being responsive to the velocity of said wire strand and adapted to output an analogous representation of a wire velocity increase or decrease;

(iv) logic means coupled to said left and right zone sense means, said first responsive means and said left and right drive means, said logic means being adapted to activate said left drive means in first and opposite directions whenever said wire velocity increases or decreases respectively and said flyer carriage is within said left zone, and to activate said right drive means in first and opposite directions whenever said wire velocity increases or decreases respectively and said flyer carriage is within said right zone, whereby, said first direction of said left and right drive means is selected to drive said left reversal means to the right and said right reversal means to the left respectively, thereby adjusting the positions of said reversal means with respect to said flyer carriage so as to eliminate increases and decreases in said velocity of said wire strand due to accumulations and recesses respectively of said bunched wire adjacent said flanges of said take-up reel, and each traverse of said flyer carriage substantially corresponds to the distance between said flanges of said reel.

12. The apparatus of claim 11 wherein said logic means further comprises counter means adapted to count the number of sequential occurrences of a change in the velocity of said wire strand when said flyer carriage is in one of said zones, said logic means being configured not to activate the appropriate drive means unless and until said counter means reaches a pre-determined number of sequential occurrences of the condition for which adjustment of said reversal means is required, whereby, said logic means can discriminate wire strand velocity changes due to accumulations and recesses of said bunched wire adjacent said reel flanges from wire strand velocity changes due to other causes.

13. The apparatus of claim 12 having in addition thereto means for resetting said counter means after each activation of said left and right drive means.

14. The apparatus of claim 11 wherein said logic means further comprises timer means coupled to said first and second drive means, said timer means being adapted to cause said drive means to be activated only for a pre-determined period following detection of a change in said wire strand velocity.

15. The apparatus of claim 10 having in addition thereto, second control means for automatically adjusting the positions of said left and right reversal means comprising:

(i) left and right drive means coupled to said left and right reversal means respectively for moving the same relative to said flyer carriage;

(ii) left and right time delay means mounted on said frame and coupled to said left and right reversal means respectively, said time delay means being adapted to provide an output for a pre-determined interval whenever said corresponding reversal means is activated by said activating means, said pre-determined time intervals defining when said flyer carriage is within left and right zones with respect to said left and right reversal means respectively;

(iii) first means coupled to a strand of said wire being drawn into said apparatus, said first means being responsive to the velocity of said wire strand and adapted to output an analogous representation of a wire velocity increase or decrease;

(iv) logic means coupled to said left and right time delay means, said first responsive means and said left and right drive means, said logic means being adapted to activate said left drive means in first and opposite directions whenever said wire velocity increases or decreases respectively and said flyer carriage is within said left zone, and to activate said right drive means in first and opposite directions whenever said wire velocity increases or decreases respectively and said flyer carriage is within said right zone, whereby, said first direction of said left and right drive means is selected to drive said left reversal means to the right and said right reversal means to the left respectively, thereby adjusting the positions of said reversal means with respect to said flyer carriage so as to eliminate increases and decreases in said velocity of said wire strand due to accumulations and recesses respectively of said bunched wire adjacent said flanges of said take-up reel, and each traverse of said flyer carriage substantially corresponds to the distance between said flanges of said reel.

16. The apparatus of claim 1 wherein said variable ratio drive means comprises:

(i) an infinitely variable transmission means having a first shaft coupled to said input shaft, a control shaft coupled to said control means for adjusting the ratio thereof, and a first output shaft, the position of said control shaft being determined by said control means; and (ii) a differential transmission means having third and fourth shafts and a second output shaft, said third and fourth shafts thereof being coupled to said first output shaft of said infinitely variable transmission means and to said input shaft respectively, and said second output shaft thereof being coupled to said reel shaft, whereby, the ratio of the rate of rotation of said reel shaft to that of said input shaft is a pre-determined function of the position of said control shaft of said infinitely variable transmission means.

17. The apparatus of claim 1 wherein said control means for adjusting the ratio of said variable ratio drive means comprises:

(i) first means coupled to a strand of said wire being drawn into said apparatus, said first means being responsive to the velocity of said wire strand and adapted to provide an analogous representation thereof;

(ii) means for selecting the desired lay length of said bunched wire being wound, for a given rate of rotation of said flyer, said selection means being adapted to provide an analogous representation of a desired wire velocity corresponding to said desired lay length;

(iii) second means coupled to said first responsive means and said selection means, said second means being responsive to a pre-determined difference between said analogous representations of said wire strand velocity and said desired wire strand velocity, and being adapted to output first and second error signals whenever said difference is positive and negative respectively;

(iv) servo motor means having an input coupled to said second responsive means through servo control means and an output coupled to said variable ratio drive means, said servo control means being adapted to activate said servo motor means in first and opposite directions whenever said first and second error signals appear respectively, whereby, activation of said servo motor means in said first and opposite directions adjusts the ratio of said variable ratio drive means so as to increase and decrease the relative rate of rotation of said reel shaft respectively, thereby maintaining said desired lay length.

18. The apparatus of claim 17 wherein said first responsive means of said control means is an electrical generator adapted to output a first electrical signal proportional to said wire strand velocity, said second responsive means thereof is an electrical comparator electrically coupled to the outputs of said first means and said lay length selection means, and wherein said lay length selection means comprises a second electrical generator coupled to said input shaft and adapted to output a second electrical signal proportional to the rate of rotation thereof, means for selectively providing a third electrical signal proportional to said desired lay length, and means for multiplying said second and third signals, the output thereof being a fourth electrical signal proportional to said desired lay length.

19. The apparatus of claim 17 wherein said first responsive means of said control means is the rotor shaft of an electrical generator having a housing, said second responsive means comprises said generator and a hollow shaft rotatably mounted in said frame, said housing being disposed coaxially and drivably within said hollow interior of said shaft, and said lay length selection means comprises a variable ratio transmission having means for selecting said ratio, said variable ratio transmission being coupled between said input shaft and said hollow shaft, whereby, said generator is responsive to a pre-determined difference in the respective rates of rotation of said generator rotor shaft and said generator housing.

20. The apparatus of claim 17 wherein said control means further comprises means for suppressing the appearance of said first and second error signals unless said error signals persist for a pre-determined period, said suppression means being coupled between said second responsive means and said servo control means, whereby, said control means does not respond to transients, and allows time for a prior adjustment of said ratio of said variable ratio drive means to be effectuated.

21. The apparatus of claim 17 wherein said control means further comprises a timer means coupled between said second responsive means and said servo control means, said timer means being adapted to cause said servo means to be activated only for a pre-determined period following the appearance of said error signal.

22. In a wire twisting and winding apparatus having a (i) main frame, (ii) a flyer rotatably coupled thereto, (iii) a reel shaft having a first axis of rotation and being rotatably mounted to said main frame, and (iv) a reel spindle having a second axis of rotation and being drivably coupled to said reel shaft, said reel shaft being adapted to receive a take-up reel, the improvement comprising:

(a) a pivot frame pivotally mounted on said main frame and adapted to rotate about a third axis of rotation parallel to said second axis of rotation, approximately 90° between a first substantially horizontal position and a second substantially vertical position, and (b) means for coupling said reel spindle to said reel shaft comprising continuous, rotatable torque transmission means adapted to transmit torque from said first axis of rotation, notwithstanding the position of said pivot frame, whereby said take-up reel and pivot frame can be pivoted between said first and second positions thereof without disengagement of said torque transmission means, for unloading and operating said take-up reel respectively.

23. In a wire winding apparatus having a main frame, a reel shaft having a first axis of rotation and being rotatably mounted to said main frame, and a reel spindle having a second axis of rotation and being drivably coupled to said reel shaft, said reel shaft being adapted to receive a take-up reel, the improvement comprising:

(a) a pivot frame pivotally mounted on said main frame and adapted to rotate about a third axis of rotation parallel to said second axis of rotation, approximately 90° between a first substantially horizontal position and a second substantially vertical position, and (b) means for coupling said reel spindle to said reel shaft comprising continuous, rotatable torque transmission means adapted to transmit torque from said first axis of rotation to said second axis of rotation through said third axis of rotation, notwithstanding the position of said pivot frame, whereby said take-up reel and pivot frame can be pivoted between said first and second positions thereof without disengagement of said torque transmission means, for unloading and operating said take-up reel respectively.

24. The improvement of claim 22 wherein said reel spindle is disposed coaxially with said flyer.

25. In a wire twisting and winding apparatus having a frame, input and reel shafts rotatably mounted on said frame and inter-coupled by a variable ratio drive means, first means for driving said input shaft, and a take-up reel rotatably mounted to a first part of said frame and drivably coupled to said reel shaft for taking up twisted wire, the improvement comprising:

(a) a flyer rotatably mounted on a flyer carriage and drivably coupled to said input shaft, said flyer carriage being reciprocally mounted to a second part of said frame separated from said first part thereof;

(b) second means for reciprocally driving said flyer carriage, said second means being separate from said first means for driving said input shaft;

(c) control means coupled to said variable ratio drive means for adjusting the ratio thereof during the winding of said twisted wire onto said reel so as to vary the rate of rotation of said reel shaft relative to that of said input shaft by an amount corresponding to the build-up of said wire on said reel, whereby, said twisted wire is given a single twist for each rotation of said flyer, and said wire is wound onto said reel in distributed layers between left and right flanges thereof.

26. The improvement of claim 25 wherein said flyer is drivably coupled to said input shaft by means comprising:

(i) a spline jack-shaft having a hollow coaxial interior rotatably mounted on said flyer carriage and drivably coupled to said flyer;

(ii) a spline nut coaxially disposed within said hollow interior of said spline jack-shaft and adapted to transmit torque thereto; and (iii) a spline shaft rotatably mounted to said frame and disposed coaxially within said hollow interior of said spline jack-shaft in slidable engagement with said spline nut, said spline shaft being drivably coupled to said input shaft.

27. In a wire twisting and winding apparatus having a frame, a flyer rotatably coupled thereto, input and reel shafts rotatably mounted on said frame and inter-coupled by a variable ratio drive means, means for driving said input shaft, and a take-up reel drivably coupled to said reel shaft, an improved control means for adjusting the ratio of said variable ratio drive means during the winding of twisted wire onto said reel so as to maintain a desired lay length thereof for a given rate of rotation of said flyer, said improved control means comprising:

(a) first means coupled to a strand of said wire being drawn into said apparatus, said first means being responsive to the velocity of said wire strand and adapted to provide an analogous representation thereof;

(b) means for selecting said desired lay length of said twisted wire being wound, said selection means being adapted to provide an analogous representation of a desired wire velocity corresponding to said desired lay length;

(c) second means coupled to said first responsive means and said selection means, said second means being responsive to a pre-determined difference between said analogous representations of said wire strand velocity and said desired wire strand velocity, and being adapted to output first and second error signals whenever said difference is positive and negative respectively;

(d) servo motor means having an input coupled to said second responsive means through servo control means and an output coupled to said variable ratio drive means, said servo control means being adapted to activate said servo motor means in first and opposite directions whenever said first and second error signals appear respectively, whereby, activation of said servo motor means in said first and opposite directions adjusts the ratio of said variable ratio drive means so as to vary the rate of rotation of said reel shaft relative to said input shaft, thereby maintaining said desired lay length.

28. The apparatus of claim 27 wherein said first responsive means of said control means is an electrical generator adapted to output a first electrical signal proportional to said wire strand velocity, said second responsive means thereof is an electrical comparator electrically coupled to the outputs of said first means and said lay length selection means, and wherein said lay length selection means comprises a second electrical generator coupled to said input shaft and adapted to output a second electrical signal proportional to the rate of rotation thereof, means for selectively providing a third electrical signal proportional to said desired lay length, and means for multiplying said second and third signals, the output thereof being a fourth electrical signal proportional to said desired lay length.

29. The apparatus of claim 27 wherein said first responsive means of said control means is the rotor shaft of an electrical generator having a housing, said second responsive means comprises said generator and a hollow shaft rotatably mounted in said frame, said housing being disposed coaxially and drivably within said hollow interior of said shaft, and said lay length selection means comprises a variable ratio transmission having means for selecting said ratio, said variable ratio transmission being coupled between said input shaft and said hollow shaft, whereby, said generator is responsive to a pre-determined difference in the respective rates of rotation of said generator rotor shaft and said generator housing.

30. The apparatus of claim 27 wherein said control means further comprises means for suppressing the appearance of said first and second error signals unless said error signals persist for a pre-determined period, said suppression means being coupled between said second responsive means and said servo control means, whereby, said control means does not respond to transients, and allows time for a prior adjustment of said ratio of said variable ratio drive means to be effectuated.

31. The apparatus of claim 27 wherein said control means further comprises a timer means coupled between said second responsive means and said servo control means, said timer means being adapted to cause said servo motor means to be activated only for a pre-determined period following the appearance of said error signal.

32. In a wire twisting and winding apparatus having a frame, input and reel shafts rotatably mounted on said frame and inter-coupled by an improved variable ratio drive means, means for driving said input shaft, a take-up reel drivably coupled to said reel shaft, and control means coupled to said variable ratio drive means for adjusting the ratio thereof during the winding of said twisted wire onto said reel so as to vary the rate of rotation of said reel shaft relative to that of said input shaft by an amount corresponding to the build-up of said wire on said reel, said improved variable ratio drive means comprising:

(a) an infinitely variable transmission means having a first shaft coupled to said input shaft, a control shaft coupled to said control means for adjusting the ratio thereof, and a first output shaft, the position of said control shaft being determined by said control means; and (b) a differential transmission means having third and fourth shafts and a second output shaft, said third and fourth shafts thereof being coupled to said first output shaft of said infinitely variable transmission means and to said input shaft respectively, and said second output shaft thereof being coupled to said reel shaft, whereby, the ratio of the rate of rotation of said reel shaft to that of said input shaft is a pre-determined function of the position of said control shaft of said infinitely variable transmission means.

33. In a wire twisting and winding apparatus having a main frame, a flyer rotatably coupled thereto and a reel shaft rotatably mounted to said main frame and drivably coupled to a reel spindle adapted to receive a take-up reel, the improvement comprising:

(a) a pivot frame pivotably mounted on said main frame and adapted to rotate approximately 90° between a first substantially horizontal position and a second substantially vertical position, said reel spindle being rotatably mounted on said pivot frame; and (b) means for coupling said reel spindle to said reel shaft comprising a reel jack-shaft rotatably mounted on said pivot frame and disposed coaxially with the axis of said pivot frame, first means for drivably coupling said reel shaft to said reel jack-shaft and second means for drivably coupling said reel jack-shaft to said reel spindle, whereby said pivot frame may be rotated between said first and second positions thereof without displacement of said first and second coupling means, thereby enabling said take-up reel to be loaded onto and unloaded from said reel spindle when said pivot frame is in said first position, and in an operational mode when said pivot frame is in said second position.

* * * * *

UNITED STATES PATENT AND TRADEMARK OFFICE

CERTIFICATE OF CORRECTION

PATENT NO. : 4,235,070

DATED : Nov. 25, 1980

INVENTOR(S) : Ben Bravin

It is certified that error appears in the above-identified patent and that said Letters Patent are hereby corrected as shown below:

| COLUMN | LINE | |
|---|---|---|
| 1 | 25 | After "because the", insert --reel also reciprocates, the strands are wound in generally-- |
| 1 | 32 | After the word "velocity of", insert --the wire, which, in turn, depends upon (i) the speed differential-- |
| 4 | 62 | Delete "standing", insert --stranding-- |
| 5 | 50 | Delete "inventioned", insert --invented-- |
| 7 | 62 | Delete "caused", insert --causes-- |
| 12 | 7 | Delete "throad", insert --throat-- |

UNITED STATES PATENT AND TRADEMARK OFFICE

CERTIFICATE OF CORRECTION

PATENT NO. : 4,235,070

DATED : Nov. 25, 1980

INVENTOR(S) : Ben Bravin

It is certified that error appears in the above-identified patent and that said Letters Patent are hereby corrected as shown below:

| COLUMN | LINE | |
|---|---|---|
| 15 | 3 | After the word "control", insert --shaft 106 and an output shaft 108, and (ii) a differential-- . |
| 16 | 5 | After the word "which" delete "is",insert --it-- . |
| 16 | 24 | After the word "second", insert --input-- . |
| 19 | 35 | Delete "ora", insert --or a-- . |
| 21 | 3 | Delete "is", insert --in--. |
| 21 | 36 | Delete "istantaneous", insert --instantaneous-- . |
| 22 | 65 | Delete "fram", insert --frame-- . |
| 23 | 43 | Delete "secnd", insert --second--. |
| 23 | 63 | Delete "Vii", insert --Vi--. |
| 25 | 45 | Delete " transversed" insert --traversed-- . |

UNITED STATES PATENT AND TRADEMARK OFFICE

CERTIFICATE OF CORRECTION

PATENT NO. : 4,235,070

DATED : Nov. 25, 1980

INVENTOR(S) : Ben Bravin

It is certified that error appears in the above-identified patent and that said Letters Patent is hereby corrected as shown below:

| COLUMN | LINE | |
|---|---|---|
| 28 | 34 | Delete "comprises", insert --comprise--. |
| 29 | 26 | Delete "counter", insert --counters--. |
| 29 | 31 | Between "its" and "input", insert the word --two--. |
| 30 | 13 | Delete "or", insert --OR--. |
| 31 | 31 | After "one", insert --)--. |
| 31 | 50 | After "recess", insert --)--. |
| 37 | 21 | Between "servo" and "means", insert --motor--. |

UNITED STATES PATENT AND TRADEMARK OFFICE

CERTIFICATE OF CORRECTION

PATENT NO. : 4, 235,070

DATED : Nov. 25 1980

INVENTOR(S) : Ben Bravin

It is certified that error appears in the above-identified patent and that said Letters Patent is hereby corrected as shown below:

| COLUMN | LINE | |
|---|---|---|
| 37 | 41 | Between "rotation", and "notwithstanding" insert --(to said second axis of rotation through said third axis of rotation)--. |

Signed and Sealed this

*Thirtieth* Day of *October 1984*

[SEAL]

*Attest:*

GERALD J. MOSSINGHOFF

*Attesting Officer*

*Commissioner of Patents and Trademarks*